US005623290A

United States Patent [19]

Iida et al.

[11] Patent Number: 5,623,290

[45] Date of Patent: Apr. 22, 1997

[54] RECORDING APPARATUS AND SUPPLY SYSTEM HAVING RESIDUAL INK QUANTITY DETECTION

[75] Inventors: Hiroshi Iida, Machida; Minoru Nozawa; Akihiro Yamanaka, both of Hiratsuka, all of Japan

[73] Assignee: Canon Kabushiki Kaisha, Tokyo, Japan

[21] Appl. No.: 193,900

[22] Filed: Feb. 9, 1994

Related U.S. Application Data

[63] Continuation of Ser. No. 880,713, May 8, 1992, abandoned, which is a continuation of Ser. No. 622,187, Dec. 5, 1990, Pat. No. 5,136,309, which is a continuation of Ser. No. 304,898, Feb. 1, 1989, abandoned, which is a continuation of Ser. No. 27,198, Mar. 17, 1987, abandoned.

[30] Foreign Application Priority Data

| | | | |
|---|---|---|---|
| Mar. 19, 1986 | [JP] | Japan | 61-59559 |
| Apr. 8, 1986 | [JP] | Japan | 61-79209 |
| Jul. 3, 1986 | [JP] | Japan | 61-155186 |
| Jul. 3, 1986 | [JP] | Japan | 61-155187 |
| Jul. 3, 1986 | [JP] | Japan | 61-155188 |
| Aug. 28, 1986 | [JP] | Japan | 61-200154 |

[51] Int. Cl.[6] ..... B41J 2/175

[52] U.S. Cl. ..... 347/7; 347/37

[58] Field of Search ..... 346/140; 347/7, 347/23, 37

[56] References Cited

U.S. PATENT DOCUMENTS

| | | | |
|---|---|---|---|
| 3,093,756 | 6/1963 | Rywak | 307/88.5 |
| 3,278,704 | 10/1966 | Smith | 200/83 |
| 3,835,336 | 9/1974 | Block | 307/234 |
| 3,842,224 | 10/1974 | Weis | 200/81.9 R |
| 4,178,595 | 12/1979 | Jinnai et al. | 346/140 R |
| 4,187,511 | 2/1980 | Robinson | 346/75 |
| 4,196,625 | 4/1980 | Kern | 73/304 R |
| 4,202,267 | 5/1980 | Heinz et al. | 101/364 |
| 4,289,963 | 9/1981 | Everett | 250/231 P |
| 4,342,042 | 7/1982 | Cruz-Uribe et al. | 346/140 R |
| 4,357,748 | 11/1982 | Branson et al. | 29/622 |
| 4,415,886 | 11/1983 | Kyogoku et al. | 340/618 |
| 4,432,005 | 2/1984 | Duffield et al. | 346/140 R |
| 4,475,116 | 10/1984 | Sicking et al. | 346/140 R |
| 4,587,535 | 5/1986 | Watanabe | 346/140 R |
| 4,604,633 | 8/1986 | Kimura et al. | 346/140 R |
| 4,610,202 | 9/1986 | Ebinuma et al. | 101/364 |
| 4,636,814 | 1/1987 | Terasawa | 346/140 R |
| 4,707,713 | 11/1987 | Ayata | 346/140 |
| 4,719,475 | 1/1988 | Kiyohara et al. | 346/140 R |
| 5,136,309 | 8/1992 | Iida et al. | 346/140 |

FOREIGN PATENT DOCUMENTS

| | | | |
|---|---|---|---|
| 2617730 | 4/1976 | Germany | B41J 27/100 |
| 8023471 | 11/1980 | Germany . | |
| 3147730 | 8/1982 | Germany . | |
| 3344447 | 6/1984 | Germany . | |
| 3431048 | 3/1985 | Germany . | |
| 144185 | 11/1981 | Japan | B41J 27/00 |
| 57-103877 | 6/1982 | Japan . | |
| 59-222358 | 12/1984 | Japan | B41J 3/04 |
| 60-2369 | 1/1985 | Japan | B41J 3/04 |
| 63-11346 | 1/1988 | Japan . | |
| 2089733 | 6/1982 | United Kingdom . | |

*Primary Examiner*—Joseph W. Hartary

*Attorney, Agent, or Firm*—Fitzpatrick, Cella, Harper & Scinto

[57] ABSTRACT

A recording apparatus includes a recording head which is scanned, a supply system containing an amount of ink and a detector for the residual ink quantity in the supply system. The residual ink quantity is detected by detecting deviation of a deviation member; this deviation occurs upon a change in pressure in an ink supply path in the ink supply system. The detection is performed after a predetermined time delay with respect to a signal relating to a change of scan direction or with respect to operation of a pump.

29 Claims, 17 Drawing Sheets

RECORDING APPARATUS AND SUPPLY SYSTEM HAVING RESIDUAL INK QUANTITY DETECTION

This application is continuation of application Ser. No. 07/880,713 filed May 8, 1992, now abandoned, which in turn is a continuation of application Ser. No. 07/622,187 filed Dec. 5, 1990, now U.S. Pat. No. 5,136,309 issued Aug. 4, 1992, which in turn is a continuation of application Ser. No. 07/304,898 filed Feb. 1, 1989, now abandoned, which in turn is a continuation of application Ser. No. 07/027,198 filed Mar. 17, 1987, now abandoned.

BACKGROUND OF THE INVENTION

1. Field of the Invention

The present invention relates to a liquid injection apparatus and, more particularly, to a liquid injection apparatus having a residual ink quantity detecting means for detecting the presence/absence of ink from a change in pressure in an ink supply system and to a residual ink quantity detecting apparatus for detecting a residual quantity of ink in an ink supply source such as an ink tank.

2. Related Background Art

An ink-jet printer, which ejects ink from a small nozzle to record an image or character on a recording medium has become popular. In a printer of this type, no ink ribbon is used, and ink liquid stored in an ink tank is ejected as small ink droplets to a recording medium such as a paper sheet through an injection mechanism of a printing head, which is connected to the ink tank through a tube, thereby recording an image and the like thereon. In the ink-jet printer of this type, a mechanism for detecting a residual quantity of ink in the ink tank is normally arranged in order to prevent print errors due to ink shortage. When the residual quantity of ink becomes insufficient, an alarm sound is produced, thereby urging an operator to refill ink or to exchange an ink tank cartridge.

In some ink-jet printers in which an ink tank as an ink supply source fixed to the main body of the ink-jet printer or a recording head is mounted on a carriage, a conventional residual ink quantity detecting apparatus is arranged on a sub-ink tank mounted on the carriage. In the conventional residual ink quantity detecting apparatus, a float which includes a magnet and moves in accordance with a change in liquid level is detected by a lead switch, or a light emitting means and a light receiving means are arranged, so that when the ink level is decreased below a predetermined value, light emitted from the light emitting means reaches the light receiving means without being sealed by the ink, thereby detecting a residual quantity of ink.

However, in the conventional residual ink quantity detecting apparatus in the ink-jet printer, in particular, when it is provided to a fixed ink tank and the ink tank is flat and is constituted by a flexible bag, a change in liquid level upon decrease in quantity of ink is small. Therefore, the residual quantity of ink cannot be accurately and reliably detected.

In the conventional residual ink quantity detecting apparatus, it must be exchanged together with the ink tank when the ink tank is exchanged. Therefore, the ink tank becomes expensive.

When the residual ink quantity detecting apparatus is provided to a sub-ink tank mounted on a carriage, the liquid level in the sub-ink tank fluctuates when the carriage is moved in a predetermined direction. Therefore, an erroneous operation may occur upon residual ink quantity detection. In addition, an electrical connecting means necessary for the residual ink quantity detecting apparatus is moved together with the carriage. Therefore, the connecting portion has a problem in its reliability.

Thus, a residual ink quantity detecting apparatus which is arranged midway along an ink supply path between a recording head and an ink tank has been proposed.

FIG. 1 shows an open-air type conventional residual ink quantity detecting apparatus, as the residual ink quantity detecting apparatus of the above type. An open-air type manometer 200 is arranged midway along an ink supply path. A pair of ink presence/absence detectors 200*a* and 200*b* such as electrodes detect a decrease in ink level I.

FIG. 2 shows a closed type conventional residual ink quantity detecting apparatus. In FIG. 2, a flexible film (diaphragm) 301 constitutes part of an ink supply path. An electrode 300 is provided to the diaphragm 301. A stationary electrode 302 is brought into contact with the electrode 300 when the diaphragm 301 is moved downward in FIG. 2 upon increase in negative pressure in the ink supply path. A spring member 303 biases the diaphragm 301 upward in FIG. 2. Note that as the closed type detector, a pair of fixed photosensors are arranged, and a light shielding plate is provided to a diaphragm to be capable of shielding the optical path, thereby detecting its deviation.

However, in the ink-jet printer having the open-air type apparatus described above, an ink tank must be arranged above the level of the ink presence/absence detectors 200*a* and 200*b*. Therefore, the total height of the printer must be inevitably increased, and the printer becomes bulky. When a decrease in ink is detected and an old ink tank is exchanged with a new one, a very long period is required for recovering a liquid level I in the manometer 200. In consideration of an inoperative state or transportation of the ink-jet printer, an opening/closing means for preventing an ink leakage from the manometer and evaporation of ink causing an increase in ink viscosity or ink solidification must be arranged. Therefore, the printer becomes bulky, and its manufacturing cost is also increased.

In the closed type residual ink quantity detecting apparatus, for example, in the apparatus having the diaphragm which is partially constituted by a flexible member and detects a residual quantity of ink utilizing a deformation caused by a pressure difference between inside and outside the flexible member, as shown in FIG. 2, a detection output varies due to variations in dimension of the flexible member. Thus, the residual quantity of ink cannot be accurately detected. Since a deformation due to pressure is utilized, adjustment in the overall ink supply system, for example, adjustment of a relative level difference between the recording head and the residual ink quantity detecting apparatus, must be performed for individual ink-jet printers. Since an adjusting mechanism is arranged, the overall apparatus becomes large, and its manufacturing cost is increased.

In the ink-jet printer having the closed type residual ink quantity detecting apparatus, when an old ink tank is exchanged with a new one upon detection of decrease in ink, a very long period of time is required for recovering an initial state of the diaphragm. If a spring member having a large spring constant is used to allow quick recovery, a deviation amount of the diaphragm cannot be set to be large, and a detection precision is degraded.

In the ink-jet printer having the closed type residual ink quantity detecting apparatus, the diaphragm arranged as part of the ink supply system must be deviated with good response at very low pressure of a several tens of $mmH_2O$ at which a degradation of print quality occurs. Therefore, the diaphragm is preferably formed of a material such as a low-hardness rubber having a high flexibility. In addition, its film thickness is preferably decreased to 0.1 to 0.3 mm.

For this reason, ink in the ink supply system may be evaporated through the diaphragm 301 or air enters the ink supply system therethrough, thereby interfering with ink injection. When the print quality is degraded, a high pressure is applied to ink in the head to perform recovery. In this case, since this pressure is also applied to the diaphragm through the ink supply tube, the residual ink quantity detecting apparatus may be broken.

In the residual ink quantity detecting apparatus which is operated upon change in pressure in the ink supply system, the predetermined negative pressure, i.e., an operating pressure for the residual ink quantity detecting apparatus is very low. Therefore, the residual ink quantity detecting apparatus may be erroneously operated when a change in pressure due to a factor other than the negative pressure produced upon decrease in quantity of ink occurs.

It was found that, in a liquid injection recording apparatus shown in FIG. 3, to which the present invention is applied, the residual ink quantity detecting apparatus was erroneously operated at negative pressure produced when ink is drawn from the distal end of a recording head 1 using a pump 9 or upon change in pressure caused by movement of ink when a carriage 2 is moved.

A change in pressure in the ink system upon movement of the carriage 2 is caused during carriage turn in which the moving direction of the carriage 2 is reversed. In the mechanism shown in FIG. 3, a negative pressure is produced in the residual ink quantity detecting apparatus at the right end (right carriage turn) and a positive pressure is produced at the left end (left carriage turn). For this reason, even though the residual quantity of ink is sufficient, the residual ink quantity detecting apparatus produces an output indicating a "small" residual quantity of ink upon use of the pump and right carriage turn. On the other hand, upon left carriage turn, the apparatus produces an output indicating a "sufficient" residual quantity of ink even if the residual quantity of ink is small.

SUMMARY OF THE INVENTION

It is an object of the present invention to provide a recording apparatus which includes a compact, inexpensive residual ink quantity detecting apparatus with high detection precision which requires no systematic adjustment in the overall ink-jet printer.

According to the present invention, a recording apparatus comprises a recording head for recording by discharging ink onto a recording medium; scan means for reciprocally scanning the recording head along a main scan direction; a supply system; control means for controlling an operation including a switch of the scan means in the scan direction; residual ink quantity detecting means; output means; and residual ink quantity detection control means. The supply system is provided at a position not scanned by the scan means in the recording apparatus and contains an amount of the ink therein, and is operable in connection with the supply of ink to the recording head. The residual ink quantity detecting means detects a residual quantity of ink in the supply system, and includes a deviation member connected to an ink supply path of the ink supply system to form a part thereof. The deviation member is deviated upon a change in pressure in the ink supply path; detecting a deviation of the deviation member thereby detects the residual ink quantity. The output means outputs a signal relating the operation control of the scan direction switch of the scan means by the control means with a predetermined time delay. The residual ink quantity detection control means causes the residual ink quantity detecting means to perform a residual ink quantity detection based on the signal outputted from the output means.

It is a further object of the present invention to provide a detecting apparatus usable with a recording apparatus having a recording head, scan means and supply system as described just above, where the detecting apparatus includes a control means, a residual ink quantity detecting means, an output means and a detection control means with the above-described features.

It is another object of the present invention to provide a method of detecting a residual quantity of ink in a recording apparatus supply system, where the supply system is operable in connection with the supply of ink to a recording head reciprocally scanned along a main scan direction by a scan means, and the residual ink quantity in the supply system is detected by residual ink quantity detection means including a deviation member connected to an ink supply path of the ink supply system to form a part thereof. The deviation member of the detection means is deviated upon a change in pressure in the ink supply path, thereby detecting a residual ink quantity by detecting a deviation of the deviation member. The method includes the steps of outputting a signal relating to an operation control of a scan direction switch of the recording head by the scan means with a predetermined time delay, and detecting the residual ink quantity corresponding to the outputted signal with the predetermined time delay.

It is still another object of the present invention to provide a recording apparatus which includes a recording head; an ink supply system for containing an amount of ink to be supplied to the recording head; a carriage for mounting the recording head; scanning means for scanning the recording head along a recording medium; residual ink quantity detecting means; and control means. The residual ink quantity detecting detects a residual ink quantity in the supply system and has features as described above. The control means controls the detecting means to detect the amount of ink in the ink supply system after a lapse of a predetermined delay from a time when a direction of movement of the carriage by the scanning means is changed.

It is a further object of the present invention to provide a recording apparatus which includes a recording head; an ink supply system for containing ink to be supplied to the recording head; pump means; recovery means; residual ink quantity detecting means having the above-described features; and control means. The pump means is provided midway in an ink path extending from the ink supply system to the recording head for applying a force to supply the ink from the ink supply system. The recovery means performs a recovery operation to recover a discharge condition of the recording head. The control means controls the residual ink quantity detecting means to detect the residual ink quantity in the ink supply system with a predetermined delay after a time when the pump means applies the force to the ink.

DETAILED DESCRIPTION OF THE PREFERRED EMBODIMENTS

An embodiment of the present invention will now be described with reference to the accompanying drawings.

Figure 1:
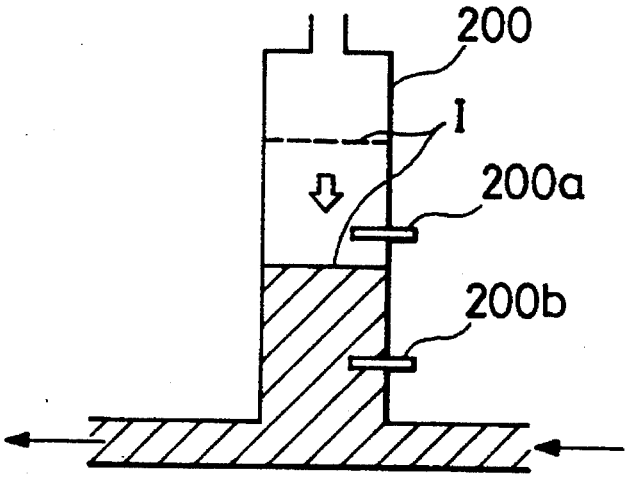
FIGS. 1 and 2 are sectional views showing two types of conventional residual ink quantity detecting apparatuses in an ink-jet printer.
Figure 2:
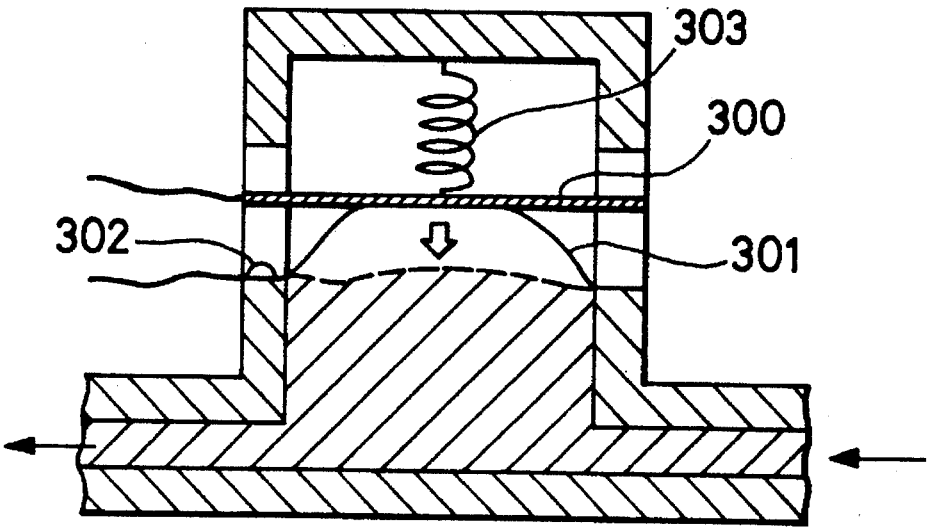
Figure 3:
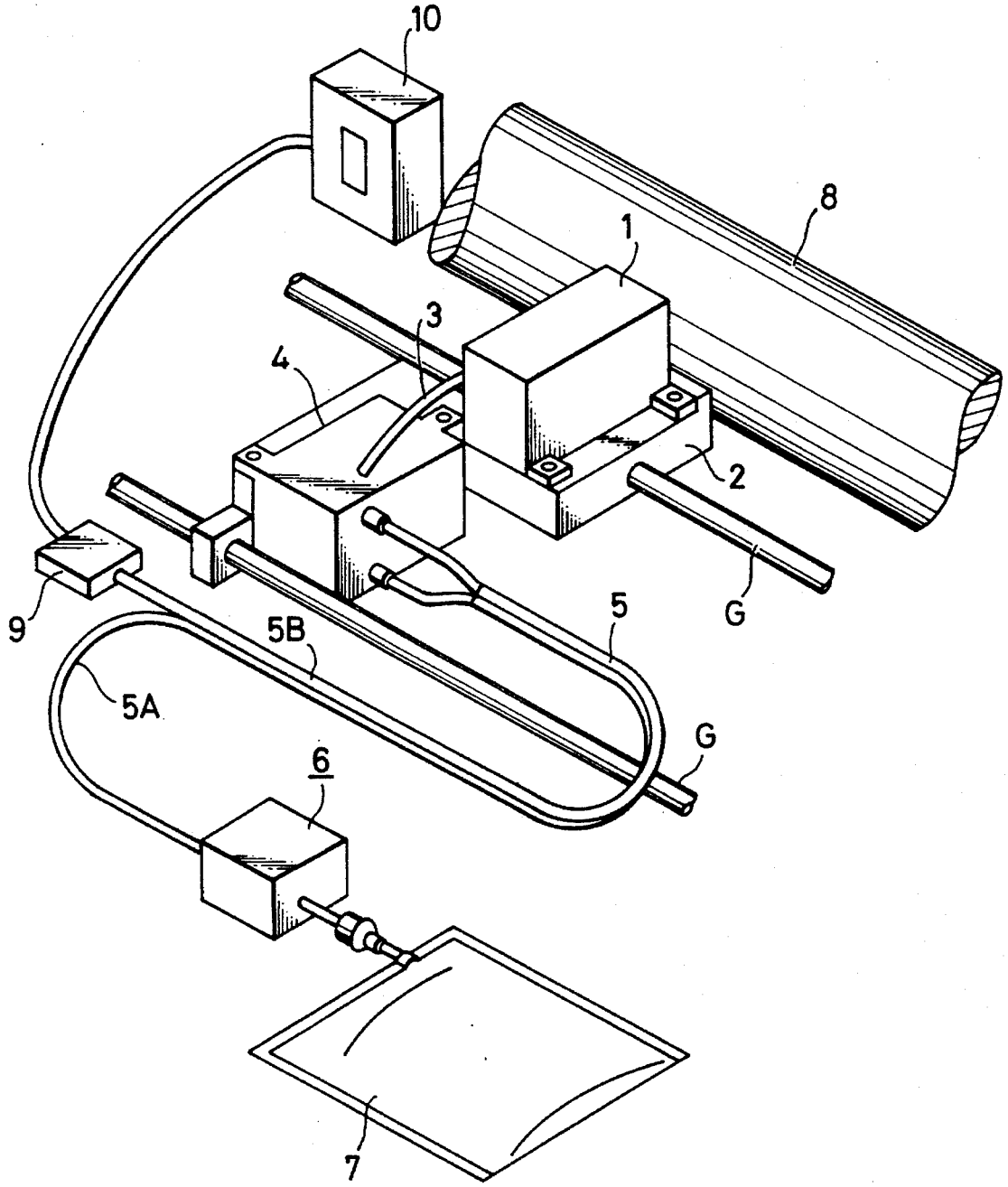
FIG. 3 is a perspective view schematically showing the arrangement of an ink-jet printer to which a residual ink quantity detecting apparatus of the present invention can be applied.

FIG. 3 shows the main part of an ink-jet recording apparatus to which the present invention is applied.

In FIG. 3, a recording head 1 ejects ink droplets to a recording medium whose recording surface is defined by a platen 8. The recording head 1 is mounted on a carriage 2, which is movable along a guide G extending in the axial direction of the platen 8. A sub-ink tank 4 is also mounted on the carriage 2. Ink stored in the sub-ink tank 4 is supplied to the recording head 1 through a supply tube 3. A flexible communicating member 5 couples a supply tube 5A for supplying ink to the sub-ink tank 4, and a pump 9, so as to maintain the quantity of ink inside the sub-ink tank 4. The pump 9 communicates with a capping 10 and draws ink from the distal end of the recording head 1 upon print error or exchange of an ink tank 7. The ink tank 7 serves as an ink supply source. In FIG. 3, the ink tank 7 is a flat, soft, flexible bag formed of a plastic, aluminum, or the like. A residual ink quantity detecting apparatus 6 is arranged midway along the supply tube 5A, and communicates with the ink tank 7.

With the above arrangement, ink stored in the ink tank 7 is supplied to the sub-ink tank 4 mounted on the carriage 2 through the residual ink quantity detecting apparatus 6 and the supply tube 5A. The ink is then supplied from the sub-ink tank 4 to the recording head 1 mounted on the carriage 2 through the supply tube 3, and is then ejected onto the recording medium on the platen 8, thereby performing a recording operation.

Figure 4:
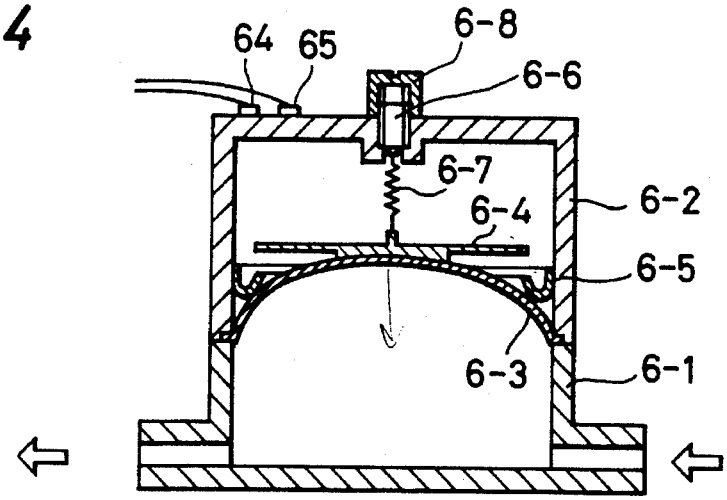
FIG. 4 is a sectional view of a residual ink quantity detecting apparatus according to an embodiment of the present invention.

FIG. 4 shows a first embodiment of the residual ink quantity detecting apparatus 6 according to the present invention. In FIG. 4, a casing 6-1 and a cover 6-2 are bonded to each other by adhesion, welding, or screws. A diaphragm 6-3 formed of a flexible member partitions a space defined by the casing 6-1 and the cover 6-2. The diaphragm 6-3 is supported by the bonded portion between the casing 6-1 and the cover 6-2 so that the space partitioned by the diaphragm 6-3 on the side of the casing 6-1 can be sealed from outer air. An electrode 6-4 formed of a conductive member is adhered to the upper portion of the diaphragm 6-3, and an electrode 6-5 is fixed to the cover 6-2 at a position opposite to the electrode 6-4.

A male screw 6-6 is arranged on the upper portion of the cover 6-2 to be vertically movable. A spring 6-7 is arranged between the male screw 6-6 and the electrode 6-4, thereby biasing the electrode 6-4 upward in FIG. 4. An adjusting screw 6-8 in which a female screw having the same diameter and pitch as those of the male screw 6-6 is threaded is arranged on the upper portion of the cover 6-2 and is engaged with the male screw 6-6. Terminals 64 and 66 are connected to the electrodes 6-4 and 6-5, respectively. The terminals 64 and 66 can be connected to an alarm means for producing a sound or performing indication or light emission with or without being connected through a control circuit and the like.

With the above arrangement, when the quantity of ink in the sealed ink tank 7 which is at least partially constituted by a flexible member is decreased, and a recording operation is continuously performed, a negative pressure in an ink system path as a whole indicated by arrows in FIG. 4 is gradually increased. In response to this, the flexible diaphragm 6-3 in the residual ink quantity detecting apparatus 6 is moved downward against the biasing force. Thus, when a predetermined negative pressure is reached, the electrodes 6-4 and 6-5 are brought into contact with each other. A signal indicating contact is supplied to a control circuit and the like through the terminals 64 and 65 connected to the electrodes 6-4 and 6-5, respectively. In this manner, an operator can know that the residual quantity of ink in the ink tank 7 is small by means of a sound or light.

The predetermined negative pressure at which the electrodes 6-4 and 6-5 are brought into contact with each other is preferably set at a value before a recording quality by the ink-jet printer is degraded. The negative pressure value is normally very small. Therefore, it is difficult to accurately detect the negative pressure due to variations in dimension of the diaphragm 6-3, variations in spring constant of a raw material, and the like. Therefore, in the first embodiment, the distance between the electrodes 6-4 and 6-5 can be changed by turning the adjusting screw 6-8, so that the spring constant of the flexible diaphragm 6-3 is virtually changed.

Figure 5:
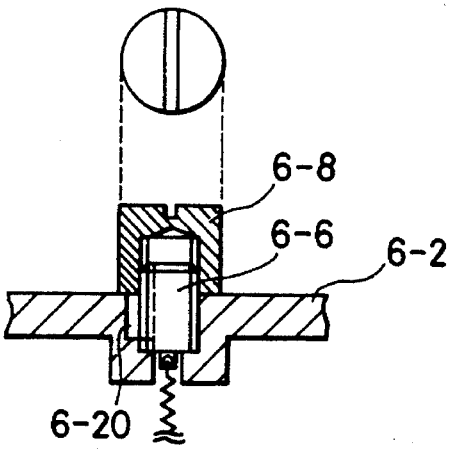
FIG. 5 illustrate a plan view and a front view showing a detailed arrangement of a detected negative pressure adjusting portion of the embodiment shown in FIG. 4.

FIG. 5 shows an adjusting portion in detail. In FIG. 5, a key 6-20 is arranged on the cover 6-2, and is coupled to a key groove formed in the male screw 6-6 so as to prevent rotation of the male screw 6-6 and to allow vertical deviation thereof. Thus, even if the adjusting screw 6-8 is turned, since the rotation of the male screw 6-6 is prevented by the key groove, the distance between the electrodes 6-4 and 6-5 can be adjusted without twisting the spring 6-7 and the flexible diaphragm 6-3. The spring constant of the spring 6-7 is determined by the negative pressure and the spring constant of the flexible diaphragm 6-3. Therefore, the present invention is not limited to the spring 6-7 but can be an elastic member having the same spring constant.

Figure 6:
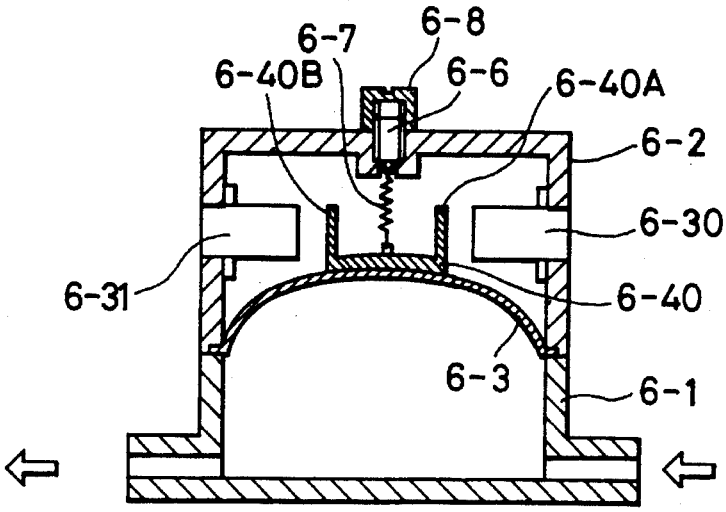
FIG. 6 is a sectional view showing another embodiment of the present invention.

FIG. 6 shows a second embodiment of the present invention. The same reference numerals in FIG. 6 denote the same parts as in the first embodiment shown in FIG. 4.

In FIG. 6, a light emitting member 6-30 and a light receiving member 6-31 are arranged on the cover 6-2. A light shielding member 6-40 is arranged on the flexible diaphragm 6-3 and has light shielding plates 6-40A and 6-40B arranged along the optical axis between the members 6-30 and 6-31.

With this arrangement, a negative pressure is generated in the supply path, and the diaphragm 6-3 is moved downward to prevent a light shielding operation of the light shielding member 6-40. Thus, when the light receiving member 6-31 receives light emitted from the light emitting member 6-30, the light receiving signal is detected by a control circuit and the like, and a similar alarm as above can be performed. Adjustment of the negative pressure can be performed in the same manner as in the first embodiment shown in FIG. 4.

Figure 7:
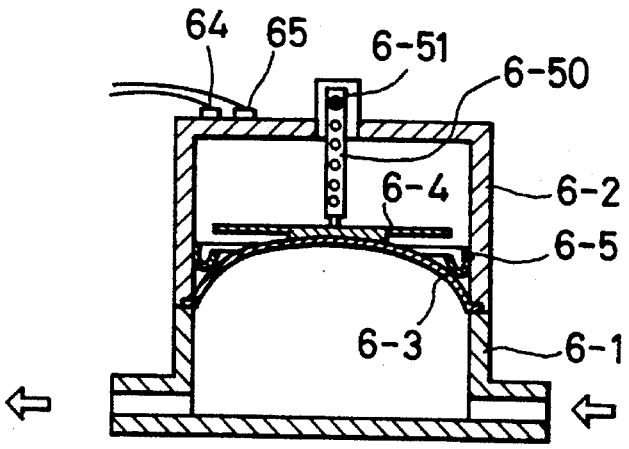
FIG. 7 is a sectional view showing still another embodiment of the present invention.

FIG. 7 shows a third embodiment of the present invention. The same reference numerals in FIG. 7 denote the same parts as in FIG. 4. In FIG. 4, an elastic member 6-50 has a proper number of holes at a proper pitch P. An adjusting portion 6-51 has a screw for coupling the elastic member 6-50 and the cover 6-2.

Figure 8A:
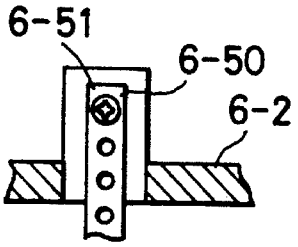
FIGS. 8A and 8B are a front view and a side view showing a detailed arrangement of a detected negative pressure adjusting portion of the embodiment shown in FIG. 7.
Figure 8B:
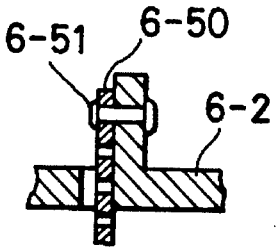

FIGS. 8A and 8B show the detailed arrangement of the adjusting portion shown in FIG. 7. FIG. 8A is a front view and FIG. 8B is a side view.

In the third embodiment, the flexible diaphragm 6-3 is suspended by the elastic member 6-50. The fixing position of the elastic member 6-50 is changed so that the flexible diaphragm 6-3 is deformed by a predetermined amount at a predetermined negative pressure, thereby obtaining the same effect as in the embodiment shown in FIG. 4.

The adjusting portion according to the third embodiment can be effectively and easily applied to the embodiment shown in FIG. 6.

According to the first to third embodiments described above, the residual quantity of ink can be detected at a properly adjusted negative pressure. Therefore, a detecting portion need not be dipped in ink, and hence, the detection reliability can be improved.

Since the detected negative pressure adjusting portion is provided to the residual ink quantity detecting apparatus, adjustment need not be performed in the ink-jet printer as a whole for residual ink quantity detection. In addition, a detected residual quantity adjusting portion need not always be arranged in the printer. Therefore, a compact, inexpensive, and highly precise residual ink quantity detecting apparatus can be realized.

Since the residual ink quantity detecting apparatus is independent of the ink tank, the apparatus can be continuously used even when the ink tank is exchanged. Therefore, the ink tank can be prepared with low cost.

The above embodiments are not limited to the ink-jet printer shown in FIG. 3 but can be applied to an ink-jet printer having a so-called full-multi type recording head in which ejection orifices are aligned over the total width of the recording medium.

As described above, according to the first to third embodiments, adjustment need not be performed in a system of the overall ink-jet printer, but easy adjustment is allowed. An inexpensive printer can be provided without increasing its size, and a residual ink quantity detecting apparatus with high detection precision can be realized.

Figure 9:
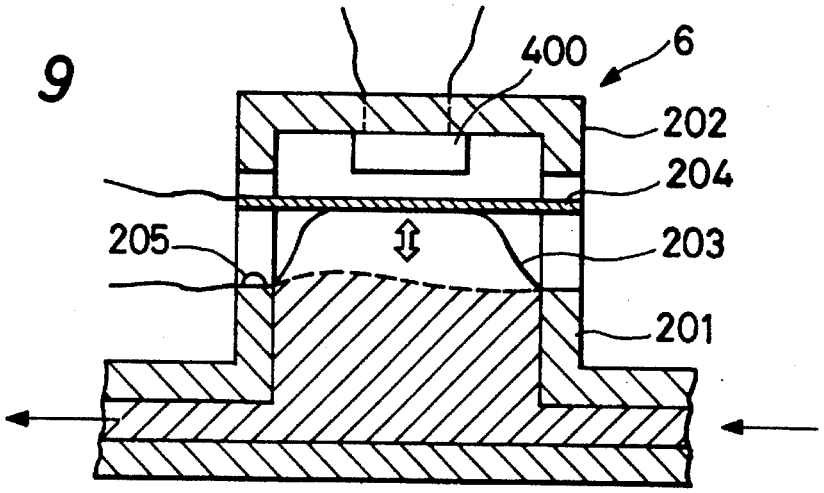
FIG. 9 is a sectional view of a residual ink quantity detecting apparatus according to still another embodiment of the present invention.

FIG. 9 shows a fourth embodiment of the residual ink quantity detecting apparatus. A casing 201 and a cover 202 are bonded to each other by adhesion, welding or screws. A diaphragm 203 is at least partially constituted by a flexible member such as an aluminum laminated film, rubber, or the like, and partitions a space defined by the casing 201 and the cover 202. The diaphragm 203 is supported by the bonding portion between the casing 201 and the cover 202 so that the space partitioned by the diaphragm 203 on the side of the casing 201 can be completely sealed from outer air. An electrode 204 having conductivity and magnetism is bonded to the upper portion of the diaphragm 203 by adhesion. An electrode 205 is fixed to the cover 202 at a position capable of being in contact with the electrode 204. A magnet 400 is arranged to face the electrode 204.

With the above arrangement, when the quantity of ink in the sealed ink tank 7 which is at least partially constituted by a flexible member is decreased, and a recording operation is continuously performed, a negative pressure in an ink system path as a whole indicated by arrows in FIG. 9 is gradually increased. In response to this, the flexible diaphragm 203 in the residual ink quantity detecting apparatus 6 is collapsed and moved downward. Thus, when a predetermined negative pressure is reached, the electrodes 204 and 205 are brought into contact with each other. A signal indicating contact is supplied to a control unit shown in FIG. 12. In this manner, an operator can know that the residual quantity of ink in the ink tank 7 is small by means of a sound or light.

The predetermined negative pressure causing the electrodes 204 and 205 to be in contact with each other is preferably set at a value before a recording quality by the ink-jet printer is degraded. This value can be determined by the rigidity of the flexible diaphragm 203 and the distance between the electrodes.

After a decrease in or the absence of ink is detected, an old ink tank is exchanged with a new one. When exchange of the ink tank is detected by a microswitch and the like, the magnet 400 is energized in response a detection signal, as will be described later, so that the magnet 400 is forcibly moved upward, thereby recovering an initial state (a state for detecting the presence of ink in the ink tank).

Figure 10:
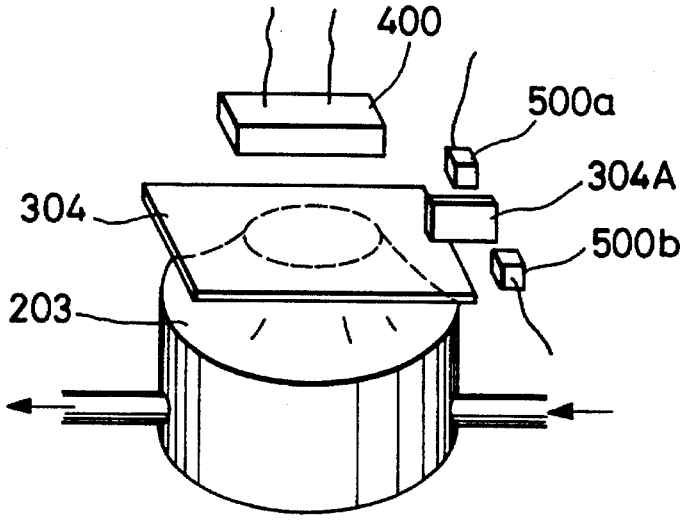
FIG. 10 is a perspective view showing still another embodiment of the present invention.

FIG. 10 shows a fifth embodiment of the residual ink quantity detecting apparatus 6. In this embodiment, a pair of photosensors 500*a* and 500*b* are stationally arranged, and a member 304 having a light shielding plate 304A capable of shielding the optical path is arranged on the flexible diaphragm 203. Other arrangements and the operation of this embodiment are the same as those in the fourth embodiment shown in FIG. 9.

According to the fifth embodiment, the residual quantity of ink can be detected in a noncontact manner, thus still improving the reliability.

Figure 11:
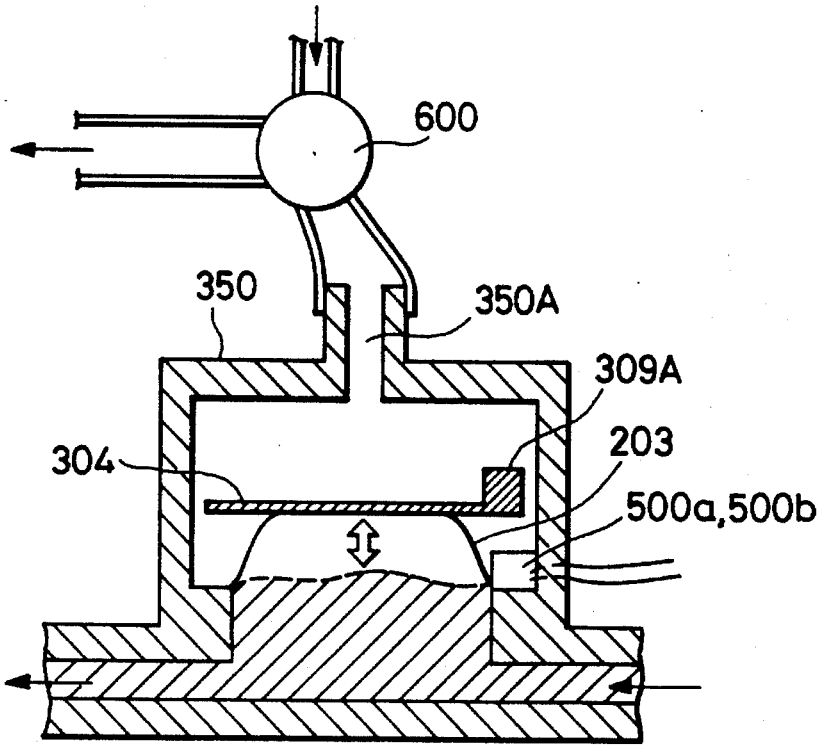
FIG. 11 is a sectional view showing still another embodiment of the present invention.

FIG. 11 shows a sixth embodiment of the residual ink quantity detecting apparatus. In the sixth embodiment, the member 304 and the photosensors 500*a* and 500*b* are arranged in a cover 350 which seals except an upper opening 350A, and the upper opening 350A is connected to a three way valve 600. Of other two openings of the valve 600, one communicates with air, and other one is connected to a suction means, e.g., a pump for recovering ejection of the recording head 1.

With the above arrangement, the valve 600 normally communicates with air, so that the flexible diaphragm 203 is easily collapsed. Upon exchange of the ink tank after a decrease in or the absence of ink is detected, the opening communicating with air of the valve 600 is closed, and the opening connected to the suction means is opened. Suction is then performed from the interior of the cover 350 to set a negative pressure state, thereby forcibly recovering the flexible diaphragm 203.

The sixth embodiment can be easily applied to an apparatus which detects a residual quantity by means of electrodes like in the fourth embodiment shown in FIG. 9.

Figure 12:
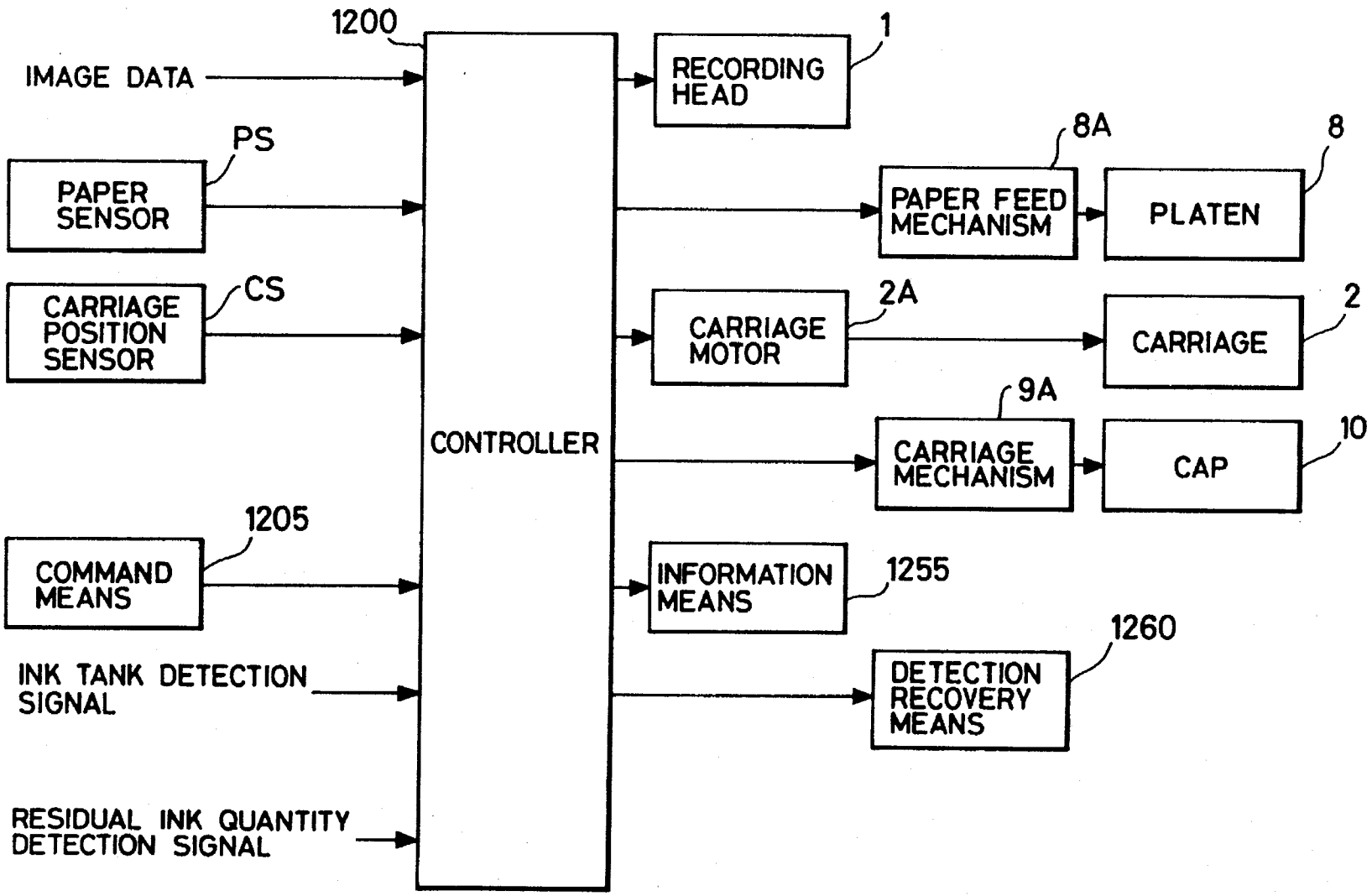
FIG. 12 is a block diagram showing the arrangement of a control system of the present invention.

FIG. 12 shows a control system of the ink-jet printer according to the present invention. The control system includes a controller 1200 such as a microcomputer having a CPU, ROM, RAM, and the like. The controller 1200 controls the respective circuit elements in accordance with the processing sequence shown in FIG. 13 stored in the ROM. The controller 1200 drives the recording head 1 in accordance with image data received from a host apparatus, thereby performing a recording operation. A paper sensor PS detects a recording paper sheet P. The controller 1200 drives the platen 8 in accordance with the detection result from the sensor PS through a paper feed mechanism 8A including a paper feed motor, thereby controlling a paper feed operation. The controller 1200 controls the drive operation or positioning operation to the home position of the carriage 2 through a carriage motor 2A in accordance with position data detected by a carriage position sensor CS.

A conveying mechanism 9A has a transmission mechanism such as gears, cams, and the like and a drive member such as a motor, and conveys the capping 10 in a direction C in FIG. 3. A command means 1205 and an information means 1255 are arranged on an operation panel (not shown), and each have keys for instructing the start of recording, and a display for displaying a message for urging an operator to exchange the ink tank or a buzzer.

A detection recovery means 1260 causes the residual ink quantity detecting apparatus to be recovered to an initial state. In the fourth and fifth embodiments shown in FIGS. 9 and 10, the means 1260 corresponds to the magnet, and in the sixth embodiment shown in FIG. 11, it corresponds to the three way valve 600 and the suction means such as a pump. In the latter case, the suction means can also serve as a suction means, coupled to the capping 10, for recovering ejection.

In the fourth embodiment shown in FIG. 9, the residual quantity detection signal corresponds to a signal produced upon contact of the electrodes 204 and 205, and in the fifth and sixth embodiments shown in FIGS. 10 and 11, it corresponds to the detection signal of the light shielding plate 304A by the photosensors 500*a* and 500*b*. An ink tank detection signal can be obtained from a limit switch which is arranged near a mounting position of the ink tank 7 in order to detect the presence/absence or exchange of the ink tank 7.

Figure 13:
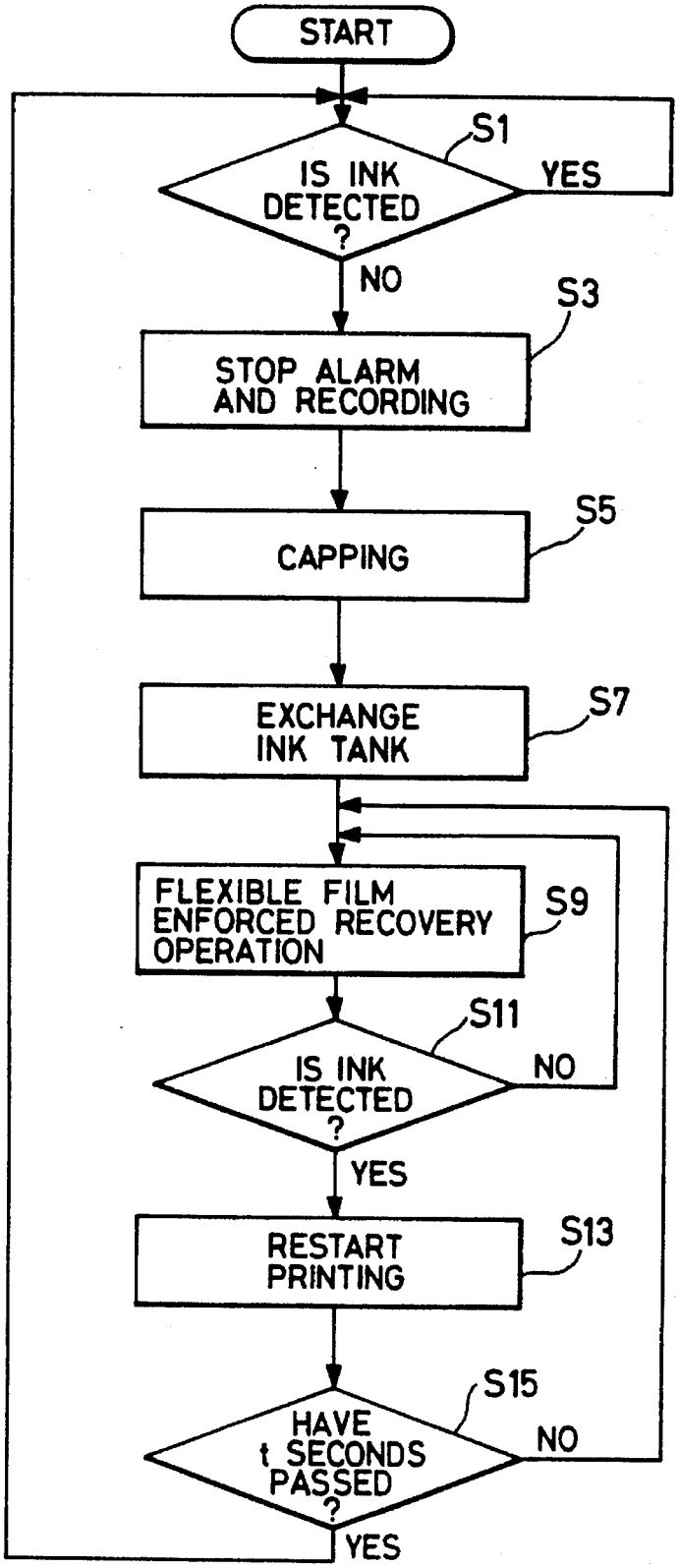
FIG. 13 is a flow chart showing a processing sequence of the present invention.

FIG. 13 shows the processing sequence when the residual quantity of ink in the ink tank 7 becomes small or the ink is used up. When a signal indicating that no ink is detected is supplied from the residual ink quantity detecting apparatus in step S1, an alarm is produced to an operator so as to urge him to exchange the ink tank by means of display or sound of the information means 1255 and the recording processing is stopped in step S3. In step S5, the carriage 2 is returned to the home position, and the capping 10 is coupled to the recording head 1, thus awaiting exchange of the ink tank by the operator.

If exchange of the ink tank 7 is detected by, e.g., a microswitch arranged at the ink tank mounting position in step S7, the ink detection recovery means 1260 is driven in step S9, so that the flexible diaphragm 203 is forcibly recovered to the initial state. This operation is repeated until ink is detected in step S11. If the ink is detected in step S11, the flow advances to step S13, and a recording restart command is output. In step S15, the driving state of the ink detection recover means 1260 is maintained for a predetermined time t (sec). The predetermined time t corresponds to a time required for recovering the negative pressure state caused by the forcible recovery processing to a state balanced with air. For example, this time can be experimentally determined in consideration of the specifications of the apparatus.

With the residual ink quantity detecting apparatus according to the embodiments described above, when the ink tank is exchanged with a new one, the apparatus is forcibly recovered to the initial state. Therefore, poor recovery response of the residual ink quantity detecting apparatus as the serious problem of the conventional ink-jet printer can be perfectly eliminated.

The present invention is not limited to the ink-jet printer shown in FIG. 3, but can be applied to an ink-jet printer having a full-multi type recording head in which ejection orifices are aligned over the total width of the recording medium. In the above embodiments, an ink tank of a detachable cartridge type is adopted. However, a fixed ink tank can be adopted, and ink can be refilled to the tank by injection.

According to the first to sixth embodiments as described above, a reliable, compact, and inexpensive ink-jet printer which will not cause an erroneous operation associated with the residual ink quantity detecting apparatus, and can quickly recovery the initial state after ink is refilled can be realized.

Figure 14:
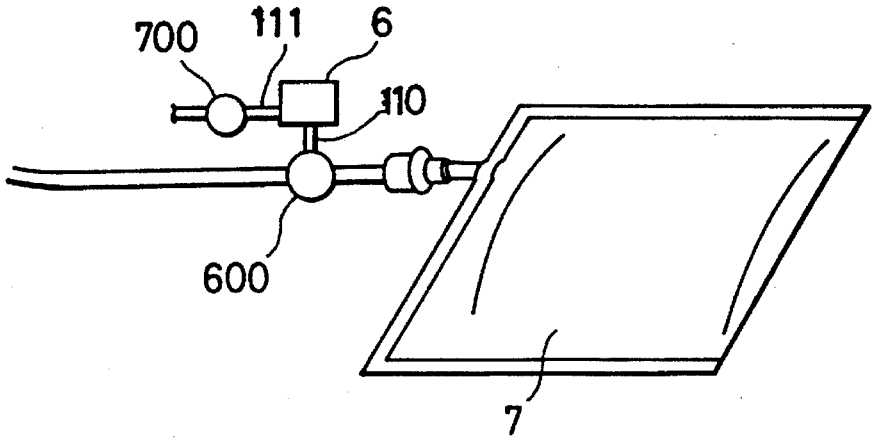
FIG. 14 is a perspective view schematically showing a residual ink quantity detecting apparatus according to a seventh embodiment of the present invention.

In still another embodiment (seventh embodiment) of the present invention, the residual ink quantity detecting apparatus is arranged as shown in FIG. 14. In FIG. 14, a three way valve 600 is connected to the residual ink quantity detecting apparatus 6 through a branch path 110 of the supply system. The apparatus 6 is connected to an open air portion 111 having a valve 700. The three way valve 600, the valve 700, and the apparatus 6 are coupled to a controller which will be described later with reference to FIG. 16.

Figure 15:
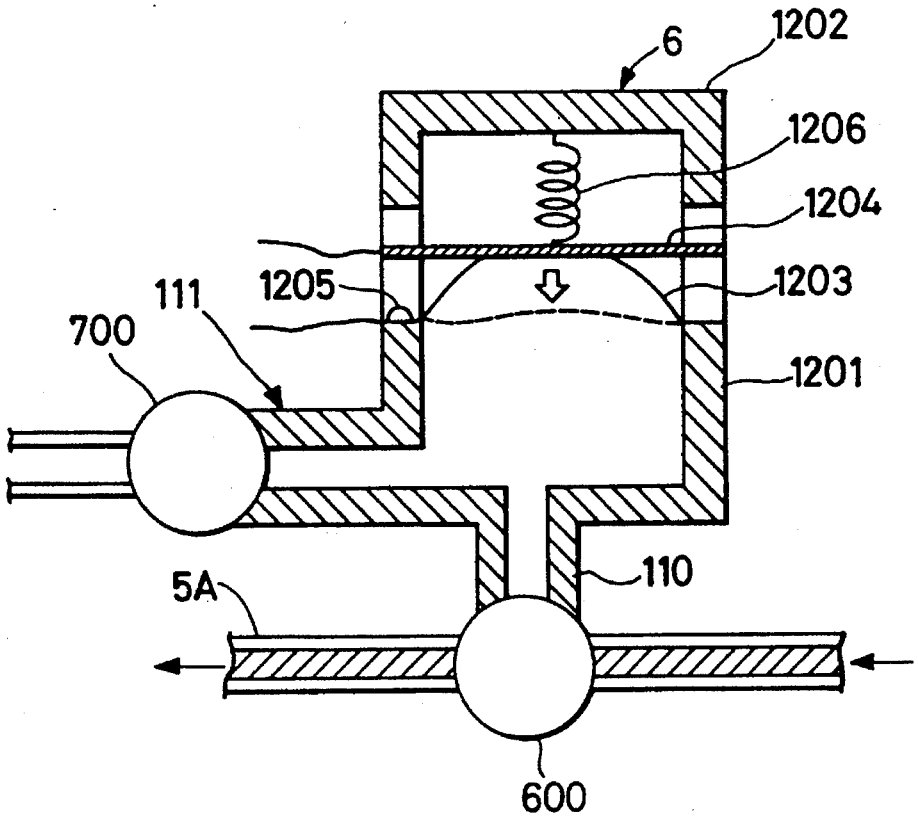
FIG. 15 is a sectional view of the residual ink quantity detecting apparatus of the second embodiment of the present invention.

FIG. 15 shows a seventh embodiment of the residual ink quantity detecting apparatus shown in FIG. 14. A casing 1201 and a cover 1202 are bonded to each other by adhesion, welding or screws. A diaphragm 1203 is at least partially constituted by a flexible member such as rubber, or the like, and partitions a space defined by the casing 1201 and the cover 1202. The diaphragm 1203 is supported by the bonding portion between the casing 1201 and the cover 1202 so that the space partitioned by the diaphragm 1203 on the side of the casing 1201 can be completely sealed from outer air. An electrode 1204 having conductivity and magnetism is bonded to the upper portion of the diaphragm 1203 by adhesion. An electrode 1205 is fixed to the cover 1202 at a position capable of being in contact with the electrode 1204.

With the above arrangement, when the quantity of ink in the sealed ink tank 7 which is at least partially constituted by a flexible member is decreased, and a recording operation is continuously performed, a negative pressure in an ink system path as a whole indicated by left arrows in FIG. 15 is gradually increased. When the three way valve 600 is opened in three ways in response to this, the flexible diaphragm 1203 in the residual ink quantity detecting apparatus 6 is depressed and moved downward. Thus, when a predetermined negative pressure is reached, the electrodes 1204 and 1205 are brought into contact with each other. A signal indicating contact is supplied to a controller shown in FIG. 16. In this manner, an operator can know that the residual quantity of ink in the ink tank 7 is small by means of a sound or light.

The predetermined negative pressure causing the electrodes 1204 and 1205 to be in contact with each other is preferably set at a value before a recording quality by the ink-jet printer is degraded. This value can be determined by the rigidity of the flexible member 1203, the spring constant of the spring 1206, and the distance between the electrodes.

The valve 700 provided to the open-air portion 111 is closed during the residual ink quantity detection. In other cases, the valve 700 is opened/closed in response to a signal from the controller shown in FIG. 16, and eliminates variations in pressure produced in the residual ink quantity detecting apparatus 6.

Note that residual ink quantity detection can be performed not only by the electrodes as above but by photosensors, and the like.

Figure 16:
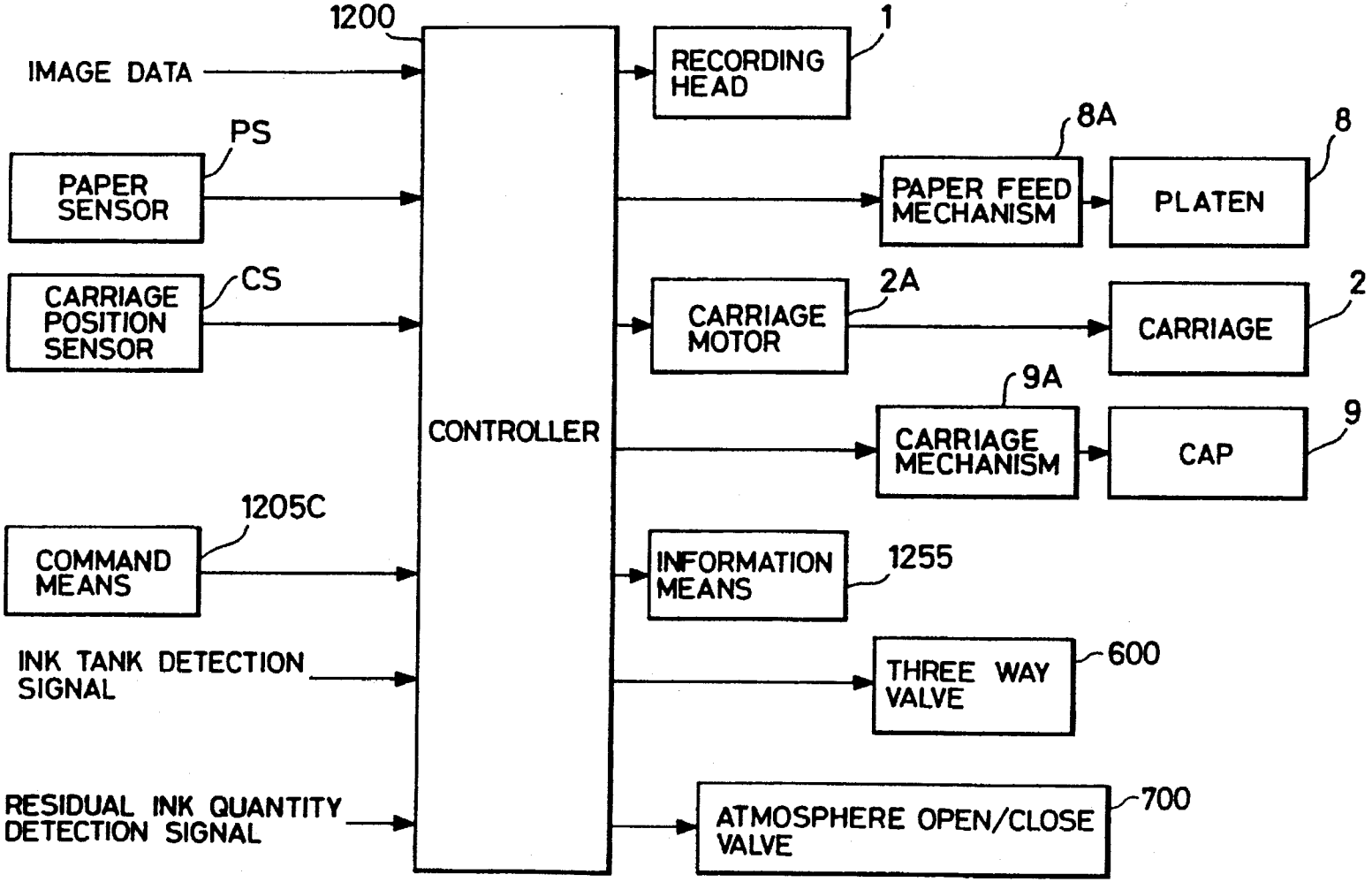
FIG. 16 is a block diagram showing a control system in the seventh embodiment of the present invention.

FIG. 16 shows a control system of the ink-jet printer according to the seventh embodiment of the present invention. The same reference numerals in FIG. 16 denote the same parts as in FIG. 12. The control system includes a controller 1200 such as a microcomputer having a CPU, ROM, RAM, and the like. The controller 1200 controls the respective circuit elements in accordance with the processing sequence shown in FIG. 17 stored in the ROM. The controller 1200 drives the recording head 1 in accordance with image data received from a host apparatus, thereby performing a recording operation. A paper sensor PS detects a recording paper sheet P. The controller 1200 drives the platen 8 in accordance with the detection result from the sensor PS through a paper feed mechanism 8A including a paper feed motor, thereby controlling a paper feed operation. The controller 1200 controls the drive operation or positioning operation to the home position of the carriage 2 through a carriage motor 2A in accordance with position data detected by a carriage position sensor CS.

A conveying mechanism 9A has a transmission mechanism such as gears, cams, and the like and a drive member such as a motor and conveys the capping 9 in a direction C in FIG. 3. A command means 1205C and an information means 1255 are arranged on an operation panel (not shown), and each have keys for instructing the start of recording, and a display for displaying a message for urging an operator to exchange the ink tank or a buzzer. The valves 600 and 700 are opened/closed in accordance with the processing sequence shown in FIG. 17.

A residual quantity detection signal can be obtained by a signal produced upon contact of the electrodes 1204 and 1205 in the seventh embodiment shown in FIG. 15.

An ink tank detection signal can be obtained from, e.g., a limit switch arranged near a mounting position of the ink tank 7 so as to detect the presence/absence or exchange of the ink tank 7.

Figure 17:
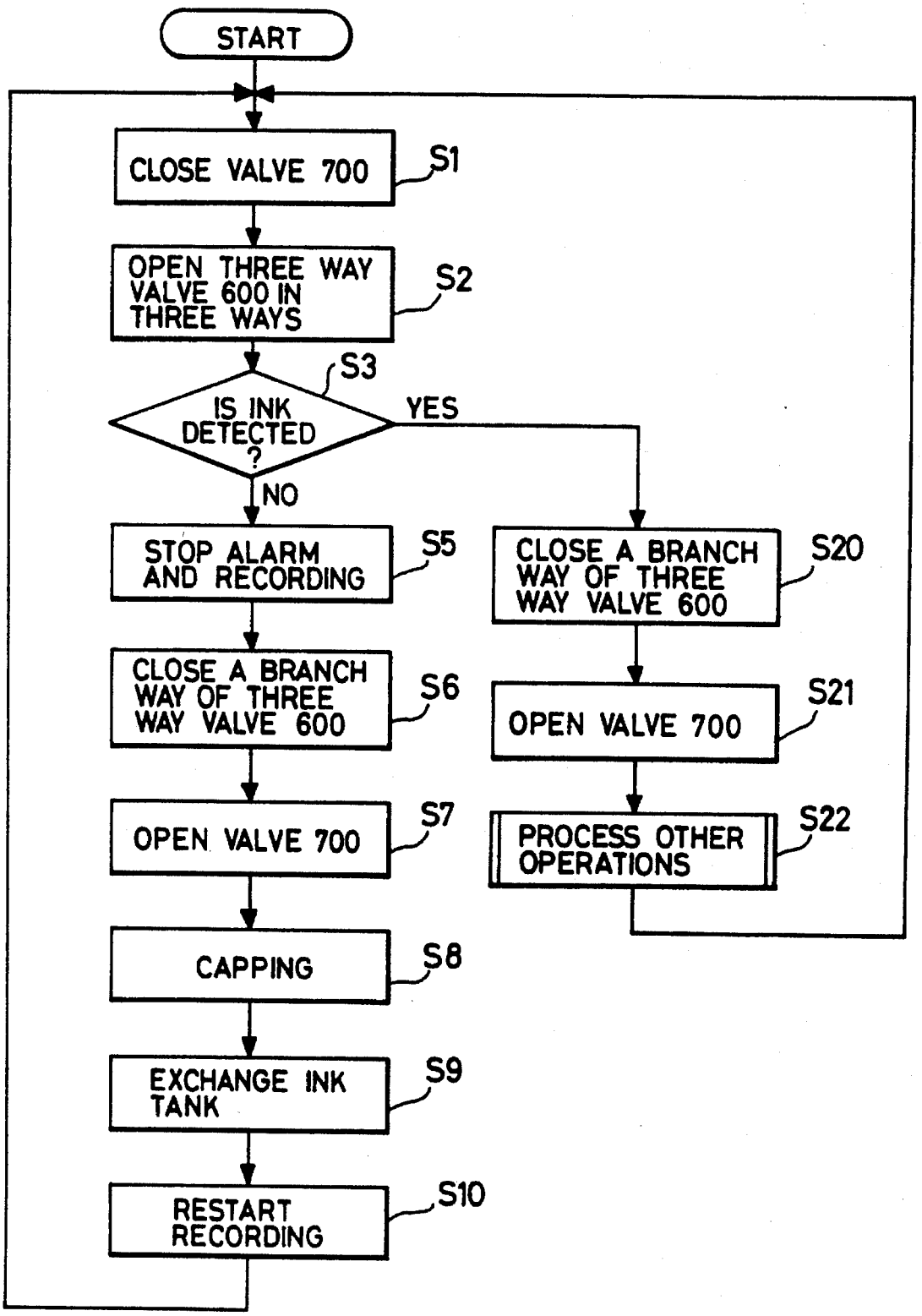
FIG. 17 is a flow chart showing a processing sequence in the seventh embodiment of the present invention.

FIG. 17 shows the processing sequence of the residual ink quantity detection in the ink tank 7. In step S1, the valve 700 in the open-air portion is closed to close the residual ink quantity detecting apparatus 6. In step S2, the three way valve 600 of the branch portion is opened in the three ways, so that the pressure in the ink supply system is transmitted to the detecting apparatus 6. If a signal indicating that no ink is detected is input from the detecting apparatus 6 in step S3, an alarm is produced to an operator so as to urge him to exchange the ink tank by means of display or sound of the information means 1255 and the recording processing is stopped in step S5. In step S6, the branch way of the three way valve 600 is closed to seal the interior of the detecting apparatus 6. In step S7, the valve 700 is open to air, and the pressure inside the detecting apparatus 6 is set to be zero as a gauge pressure.

In step S8, the carriage 2 is returned to the home position, and the recording head 1 is capped by the capping 9, thus awaiting exchange of the ink tank by the operator.

If exchange of the ink tank 7 is detected by, e.g., a microswitch arranged at the ink tank mounting position in step S9, the flow advances to step S10, and a recording restart command is output, thereby enabling the recording operation.

If YES in step S3, i.e., if it is detected by the noncontact state of electrodes 1204 and 1205 of the detecting apparatus 6 that ink is present in the supply system, the flow advances to step S20, and the branch way of the three way valve 600 is closed. In step S21, the open-air valve 700 is opened, and in step S22, other operations such as recording processing, standby processing, ejection recovery processing, and the like, are performed. During the recording processing, this processing is interrupted for every predetermined period of time or every predetermined volume of recording, and the flow returns to step S1 to execute the residual quantity detection processing.

In the ejection recovery processing, the branch way of the three way valve 600 is closed and the head 1 capped by the capping 9, in the same manner as in steps S6 and S8. In this state, a suction means coupled to the capping 9 or a compression means arranged in a proper portion of the supply system, is driven, thereby forcibly discharging ink from the ink ejection hole of the head 1. Thus, clogging of the ink ejection hole can be eliminated. In this case, a pressure transmitted to the respective portions of the supply system does not reach the detecting apparatus 6, since the branch way of the three way valve 600 is closed. Therefore, the diaphragm 203 will not be broken.

In the seventh embodiment, since the branch way of the three way valve 600 is closed except in the residual ink quantity detection mode, air entering from the diaphragm constituting the residual ink quantity detecting apparatus can be prevented from entering the ink supply system. In addition, ink in the ink supply system can be prevented from being evaporated through the diaphragm. Therefore, erroneous ejection caused by the presence of the residual ink quantity detecting apparatus can be prevented.

When the three way valve 600 is appropriately controlled, even if a high pressure is applied to the supply system during the ejection recovery processing of the head, this will not reach the detecting apparatus 6. Therefore, the diaphragm 203 can be prevented from being broken, and its service life can be greatly prolonged.

Control of the three way valve 600 is effective in terms of protection of the detecting apparatus 6 from a pressure wave produced in the supply tube 5A upon movement and stop of the carriage 2, in an apparatus for performing a recording operation in accordance with a reciprocal movement of the carriage 2, as in the seventh embodiment. This is because the branch way of the three way valve 600 is closed.

Since the open-air portion 111 having the valve 700 is connected to the detecting apparatus 6 and is open to air except in the residual ink quantity detection mode, a change in pressure inside the detecting apparatus 6 due to a change in environmental conditions such as temperature or entrance of air from the diaphragm 203 can be eliminated.

The present invention is not limited to the ink-jet printer shown in FIG. 3, but can be applied to an ink-jet printer having a full-multi type recording head in which ejection orifices are aligned over the total width of the recording medium. In the above embodiments, an ink tank of a detachable cartridge type is adopted. However, a fixed ink tank can be adopted, and ink can be refilled in the tank by injection.

According to the seventh embodiment as described above, a stable ink-jet printer which can detect the residual quantity of ink with high reliability, can prevent evaporation of ink inside the ink supply system or entrance of air inside the ink supply system through the residual ink quantity detecting apparatus, and can prevent erroneous ejection, can be realized.

The residual ink quantity detecting apparatus can be reliably protected from a high pressure produced upon ejection recovery processing of the head, and its reliability can be greatly improved.

Still another embodiment of the present invention, wherein an erroneous operation of ink detection caused by variations in pressure inside an ink supply system can be prevented, will now be described.

Figure 18:
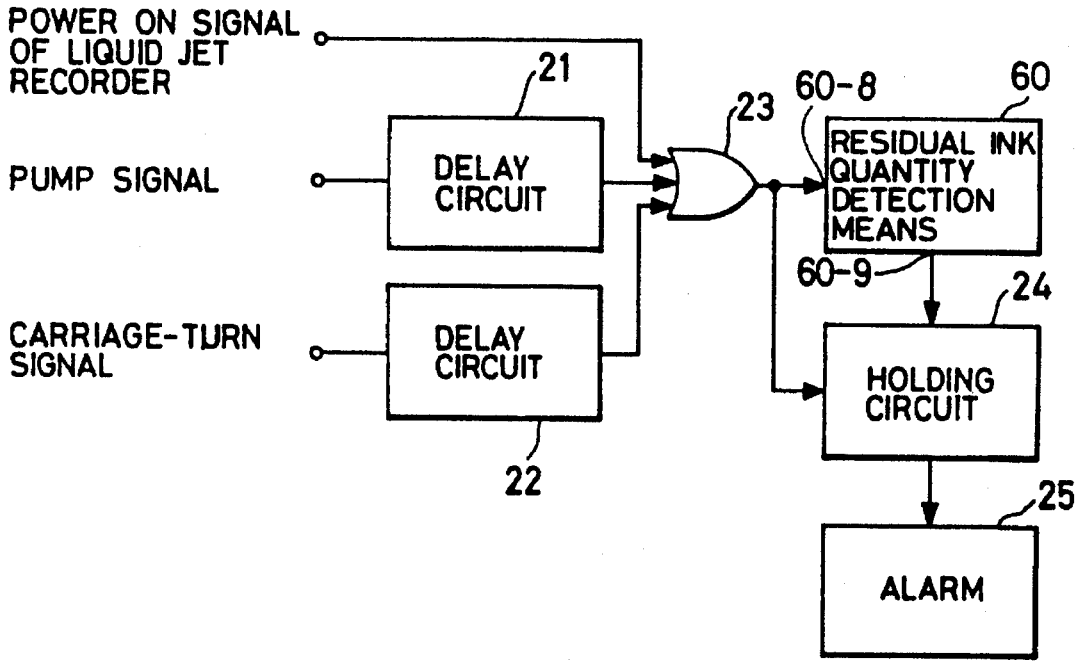
FIG. 18 is a block diagram showing a circuit arrangement in an eighth embodiment of the present invention.

FIG. 18 shows a circuit arrangement of a residual quantity detecting mechanism according to an eighth embodiment of the present invention.

In FIG. 18, a delay circuit 21 receives a pump drive start signal for driving the pump 9 to delay the output timing of this signal. A delay circuit 22 receives a carriage turn signal for causing left and right carriage turn operations of the carriage 2 to delay the output timing of this signal.

An OR gate 23 receives a power-on signal from the ink-jet printer, the pump drive start signal, and the carriage turn signal, and selectively outputs these signals when one of these signals is input. The output from the OR gate 23 is supplied to a terminal 608 of a residual ink quantity detecting means 60 and a gate input terminal of a holding circuit 24.

The holding circuit 24 serves as a latch circuit, such that it holds the residual quantity detection signal output from a terminal 60-9 of the detecting means 60 and outputs the residual quantity detection signal to an alarm device 25 when it receives a residual quantity detection command signal output from the OR gate 23.

The alarm device 25 receives the residual quantity detection signal output from the holding circuit 24, and produces an alarm sound in accordance with the content of the input signal when the residual quantity of ink becomes "small".

Figure 19:
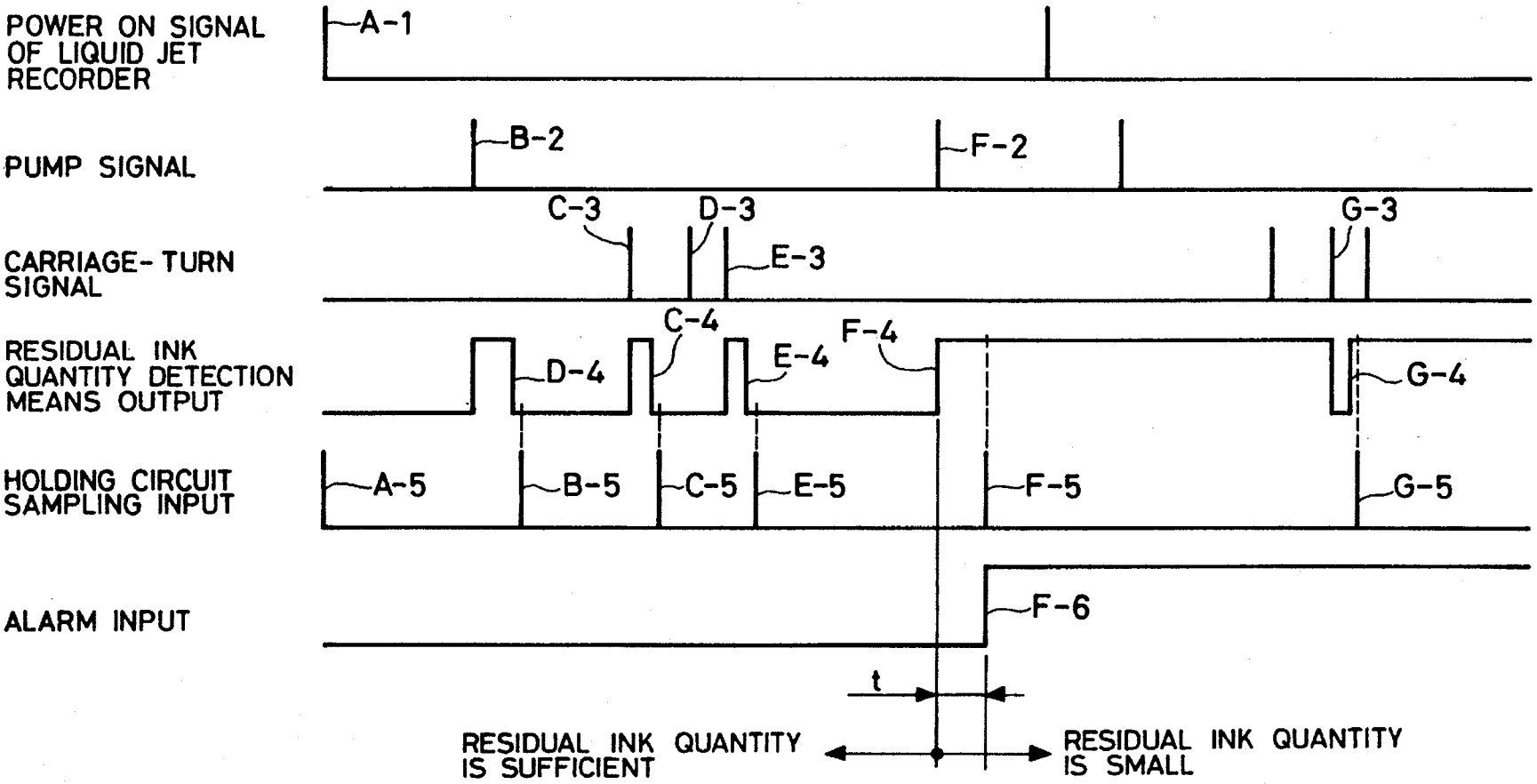
FIG. 19 is a timing chart showing signal generation timings in the eighth embodiment of the present invention.

FIG. 19 shows input/output timings of signals in the respective devices in the eighth embodiment of the present invention.

In FIG. 29, when the power source of the ink-jet printer is turned on, a power-on signal A-1 is output to the residual quantity detecting means 60 and the holding circuit 24 through the OR gate 23. If the residual quantity of ink in the ink tank 7 is "sufficient", the terminals 608 and 609 of the detecting means 60 are electrically connected to each other. Therefore, the detecting means 60 outputs the input signal from the OR gate 23 to the holding circuit 24. Note that in FIG. 19, when the terminals 608 and 609 of the detecting means 60 are electrically connected to each other, a pulse signal is not generated (signal "L"), and when they are disconnected from each other, the pulse signal is produced (signal "H").

Therefore, since the holding circuit 24 receives the residual quantity detection command signal A-5 from the OR gate 23, it outputs the residual quantity detection signal "L" to the alarm device 25, and holds the output signal "L". The alarm device 25 receives the signal "L" and determines that the quantity of ink is "sufficient".

After the power source is turned on, the recording operation is started. When the pump 9 is driven during print error, a drive signal B-2 of the pump 9 is delayed by the delay circuit 21 from the pump drive timing, and is output to the detecting means 60 and the holding circuit 24 through the OR gate 23. The delay time corresponds to a time required for completing the drive operation of the pump. The detecting means 60 is erroneously operated upon drive operation of the pump 9, as described above, and outputs a signal "H" indicated by a waveform B-4 to the holding circuit 24. When the pump drive operation is completed, the residual quantity detecting means 60 is recovered to a normal state, and outputs the residual quantity detection signal "L". Therefore, when the delayed pump signal is input to the holding circuit 24, the holding circuit 24 outputs and holds the residual quantity detection signal "L". The alarm device 25 determines that the residual quantity of ink is "sufficient". In this manner, an erroneous detection signal produced by the detecting means 60 can be prevented from being transferred to the alarm device 25. If the detecting means 60 is erroneously operated for other causes and performs erroneous detection, the erroneous detection signal will not be transferred to the alarm 25 as long as this signal is simultaneously input to the holding circuit 24 together with the detection command signal.

When the right carriage turn signal C-3 is input to the delay circuit 21, the erroneous operation time of the detecting means 60 is delayed in the same manner as in the input pump signal, and the residual quantity detection signal from the detecting means 60 is held in the holding circuit 24. Therefore, the residual quantity detection signal can be input to the alarm device 25 in a normal state.

When a left carriage turn signal D-3 is input to the delay circuit 22, since the detecting means 60 performs normal detection as described above, the alarm device 25 can receive the normal detection signal from the detecting means 60.

Residual quantity detection when the residual quantity of ink in the ink tank 7 becomes "small" will be described.

When the recording operation is performed and the quantity of ink becomes "small", a change in pressure is caused in the ink supply system, as described above, and the terminals 60-8 and 60-9 of the detecting means 60 are disconnected from each other.

In this state, if a drive signal F-2 of the pump 9 is input to the detecting means 60, the detecting means 60 continuously outputs an "H" signal F-4. The holding circuit 24 receives an output command signal F-5 from the OR gate 23, and outputs and holds an "H" residual quantity detection signal F-5 to the alarm device 25. Therefore, the alarm device 25 produces an alarm sound indicating that the residual quantity of ink is "small".

When the residual quantity of ink is "small" and left carriage turn of the carriage 2 is performed, the residual quantity detection means 60 performs an erroneous operation as described above, and outputs an "L" residual quantity detection signal G4. However, when this carriage turn is completed, the detecting means 60 is recovered to a normal state, and outputs a detection output "H". The holding circuit 24 outputs the residual quantity detection signal "H" in response to the delayed left carriage signal, i.e., the residual quantity detection command signal G5. Therefore, the erroneous detection signal from the detecting means 60 will not be transferred to the alarm device 25.

According to the eighth embodiment of the present invention as described above, while the recording operation is performed, the residual quantity of ink can be detected each time the pump is driven or the carriage turned, and an erroneous detection signal from the detecting means 60 caused by the drive operation of the pump or the carriage turn can be prevented from being output to the alarm device 25.

Figure 20:
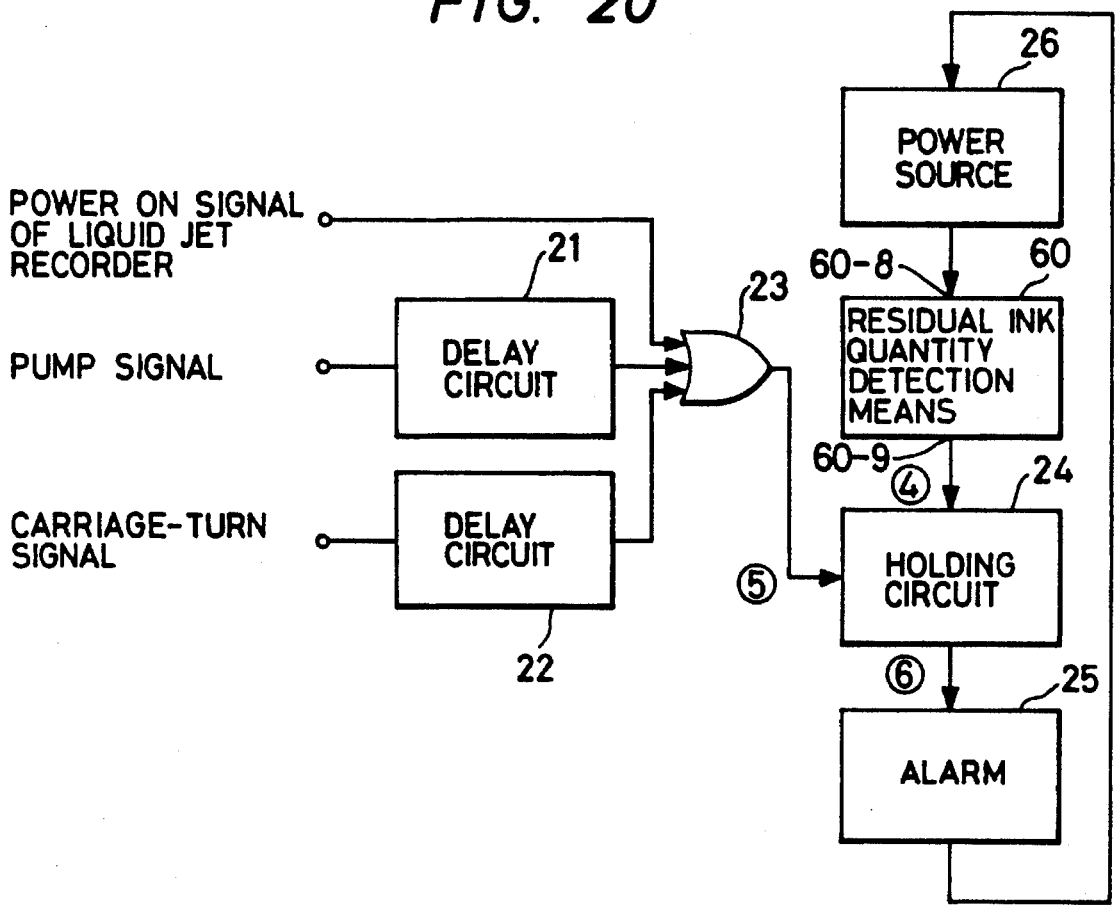
FIG. 20 is a block diagram showing a circuit arrangement in a ninth embodiment of the present invention.

FIG. 20 shows the arrangement of a ninth embodiment of the present invention.

The same reference numerals in FIG. 20 denote the same parts as in FIG. 18.

Referring to FIG. 20, a power source 26 supplies a current as a residual quantity detection signal to the residual quantity detecting means 60.

In the ninth embodiment, when the power-on signal, the carriage turn signal, and the pump drive signal are input to the OR gate 23, the OR gate 23 causes the holding circuit 24 to output the input residual quantity detection signal, in the same manner as in the eighth embodiment. Instead of inputting the output from the OR gate 23 to the detecting means 60, the power source 26 is arranged, so that the residual quantity detection signal is stably supplied to the detecting device 60.

In the ninth embodiment of the present invention, the power-on signal is input as a residual ink quantity detection command timing. However, in an ink-jet printer whose carriage 2 is moved to a home position, the timing can be taken in response to a home position movement signal.

In the eighth and ninth embodiments of the present invention, the recording head 1 is moved along the guide G. However, in a serial recording type ink-jet printer having a plurality of recording heads aligned in line without the guide G, an erroneous detection of the detecting means 60 caused by the carriage turn cannot occur, and the carriage turn signal need not be input. However, if the frequency of signal detection is to be increased, the carriage turn signal can be input.

In the eighth and ninth embodiments of the present invention, the residual quantity detection timing is instructed in accordance with the drive start signal of the pump 9. However, the drive signal for driving the pump 9 can be used thereas, as a matter of course.

In the eighth and ninth embodiment of the present invention, the signal output timings of the pump signal and the carriage turn signal are delayed by the delay circuits 21 and 22. Instead of using the delay circuits 21 and 22, an arithmetic processing device for causing the holding circuit 24 to output and hold the detection signal after a predetermined period of time has passed from the input of the pump signal and the carriage turn signal can be used.

According to the eighth and ninth embodiments of the present invention as described above, residual ink quantity detection is performed at a timing at which an erroneous operation of the detecting means is completed. Therefore, the presence/absence of ink can be effectively detected without being influenced by the erroneous operation of the residual ink quantity detecting means caused by the drive operation of the ink supply pump or carriage turn.

Figure 21:
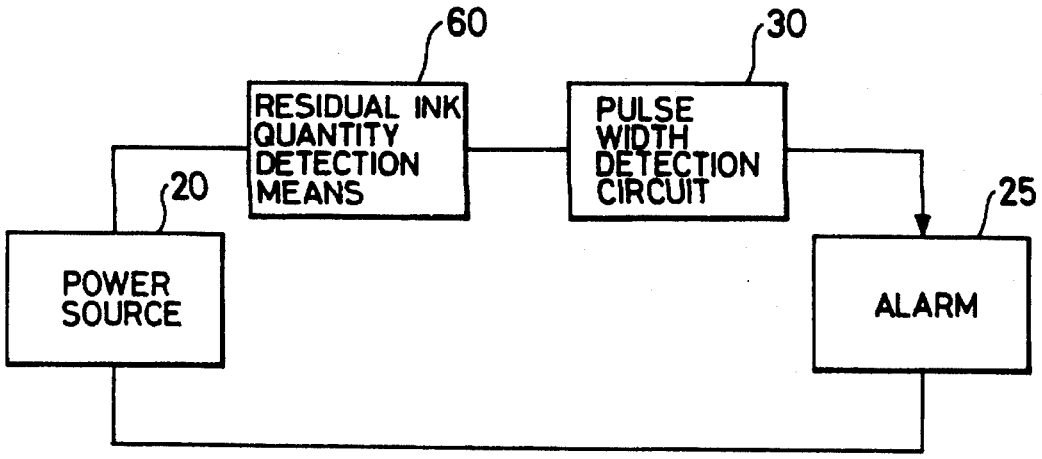
FIG. 21 is a block diagram showing a circuit arrangement in a tenth embodiment of the present invention.

FIG. 21 shows the arrangement according to a tenth embodiment of the present invention.

In FIG. 21, a power source 20 supplies a detection current to a residual ink quantity detecting means 60. An alarm device 25 receives a residual quantity detection signal indicating the presence/absence of ink from the residual quantity detecting means 60, and produces an alarm when the residual quantity of ink is "small". A pulse width detection circuit 30 according to the tenth embodiment of the present invention receives the residual quantity detection signal, and counts a pulse width t1 of the detection signal. The detection circuit 30 does not output a residual quantity detection signal having a pulse width smaller than a preset pulse width t, and outputs and holds a residual quantity detection signal input before the residual quantity detection signal having the pulse width smaller than the predetermined with is input.

An erroneous signal output interval of the residual quantity detecting means 60 due to the pump 9 or carriage turn is several seconds. Therefore, the predetermined pulse width can be set to be larger than the maximum erroneous signal output interval.

Figure 22:
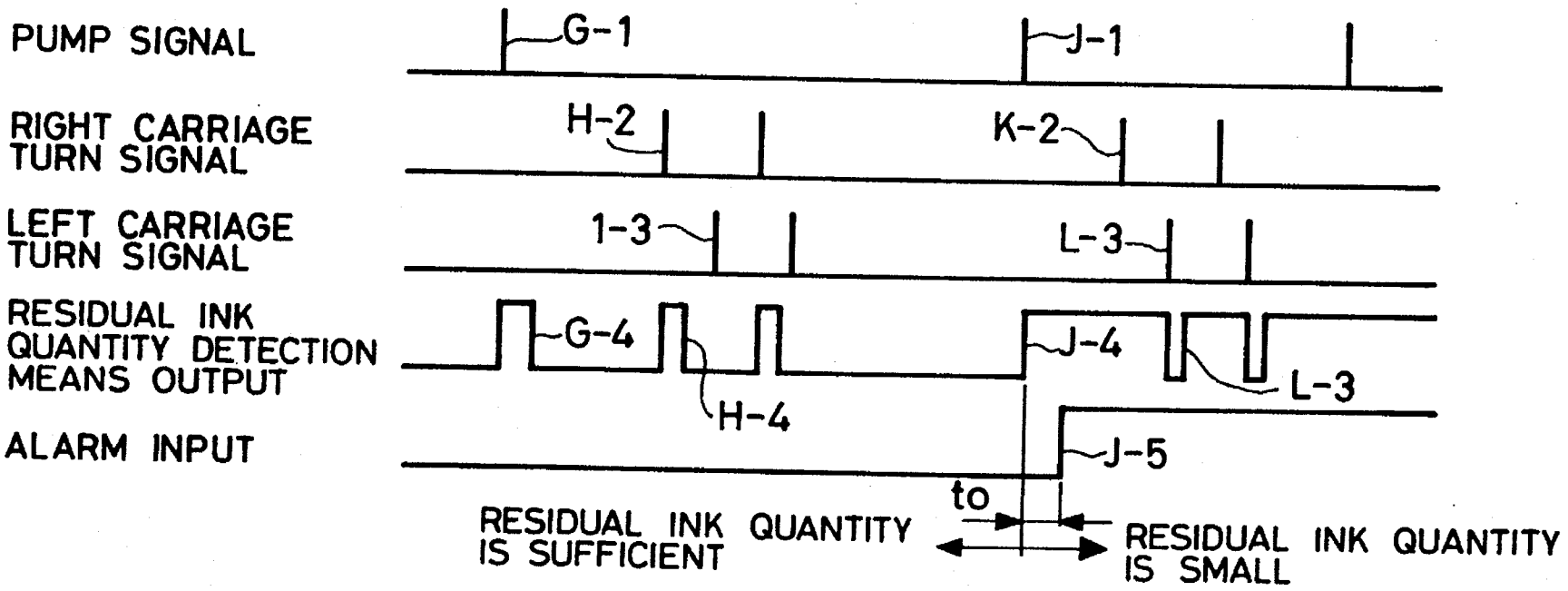
FIG. 22 is a timing chart showing the operation of a residual ink quantity detecting means 60 in the tenth embodiment of the present invention.

FIG. 22 shows the operation timing of the residual quantity detecting means 60 in the tenth embodiment of the present invention.

In FIG. 22, if the pump 9 is driven in response to a pump signal G-1 when the quantity of ink is "sufficient", the residual quantity detecting means 60 is erroneously operated as described above, and outputs a signal indicating the "small" residual quantity of ink, i.e., an "H" residual quantity detection signal G-4. When the carriage turn of the carriage 2 is performed in response to a carriage turn signal "H" for instructing the carriage turn, the detecting means 60 is also erroneously operated, and outputs an "H" residual quantity detection signal H4.

The pulse width of the signal output from the detecting means 60 as a result of the erroneous operation is smaller than the predetermined pulse width of the pulse width detection circuit 30. Therefore, the detection circuit 30 outputs a signal "L" before signal 6-4 or H-4.

Therefore, an error signal from the residual quantity detecting means 60 cannot be transferred to the alarm device 25, and the alarm device 25 will not be erroneously operated.

When the residual quantity of ink becomes "small", the residual quantity detecting means 60 outputs a residual quantity detection signal "H". When the pulse width detection circuit 30 detects that this detection signal has a pulse width larger than the predetermined pulse width t, it holds this signal. Therefore, the alarm device 25 can detect the "small" quantity of ink, and produces an alarm. A detection delay time t is several seconds, and no problem occurs in an actual use.

If a left carriage turn of the carriage 2 is performed when the quantity of ink becomes "small", the detecting means 60 outputs an "L" residual quantity detection signal L-4. However, the detection circuit 30 causes this signal not to output to the alarm device 25, and the alarm device 25 holds the signal "H".

According to the tenth embodiment of the present invention as described above, even if the residual ink quantity detecting means is erroneously operated due to a drive operation of the ink supply pump or carriage turn, the alarm device can be normally operated. Therefore, the residual quantity of ink can be reliably detected.

Figure 23:
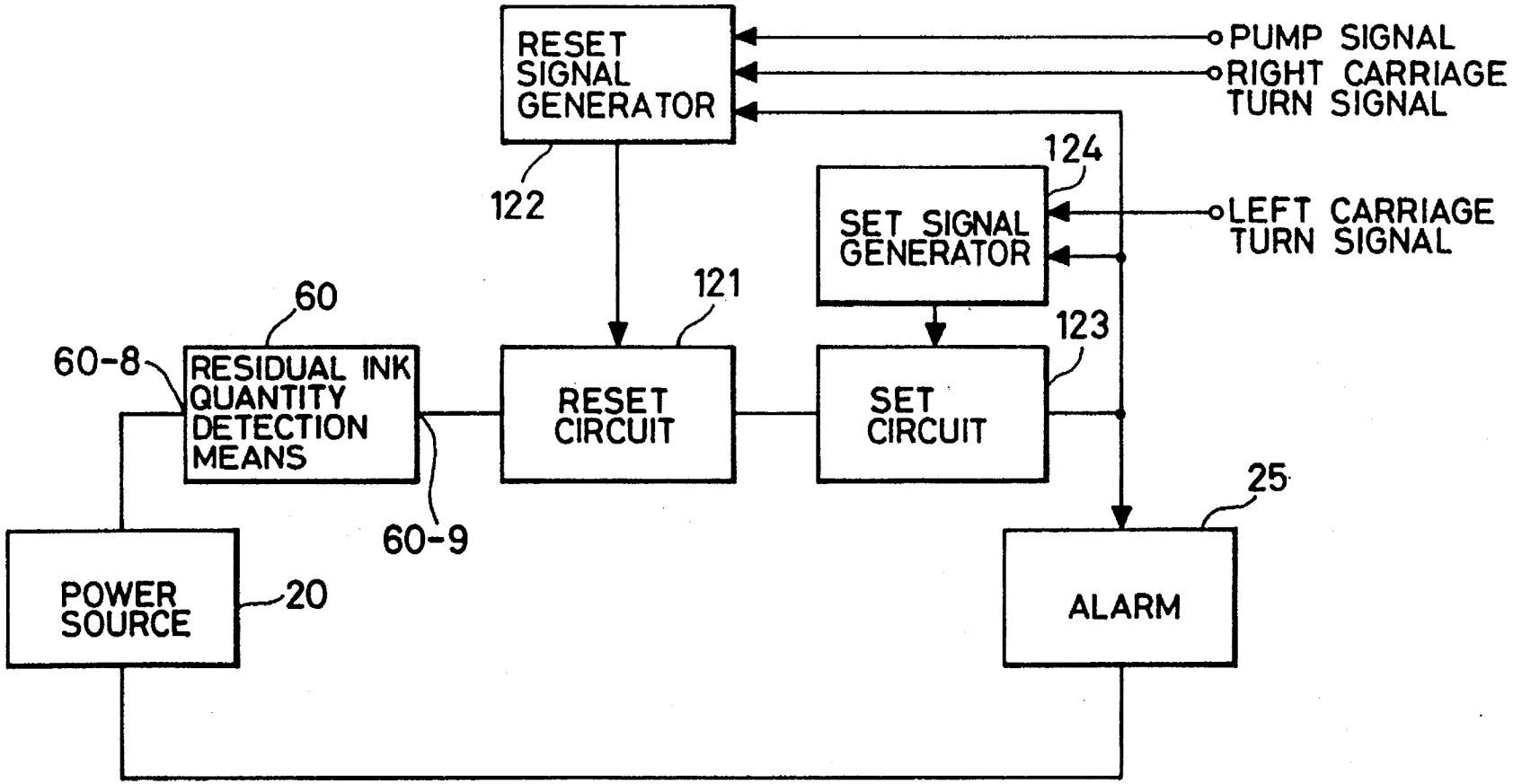
FIG. 23 is a block diagram showing a circuit arrangement in an 11th embodiment of the present invention.

FIG. 23 shows an 11th embodiment of the present invention.

An input terminal 608 of the residual quantity detecting means 60 is connected to a power source 20, and an output terminal 60-9 is connected to the input terminal of the alarm device 25 through a reset circuit 121 and a set circuit 123. When the residual quantity of ink becomes "small" the terminals 60-8 and 60-9 of the detecting means 60 are disconnected from each other, and the means 60 outputs a signal "H". When the residual quantity of ink is "sufficient", the detecting means 60 allows the current from the power source 20 to pass therethrough and outputs a signal "L". When the reset circuit 121 does not receive a reset signal from a reset signal generator 122, the circuit 121 outputs the input signal from the detecting means 60 (residual quantity detection signal) to the alarm device 25; otherwise, it sets its output signal at "L" level irrespective of the residual quantity detection signal (alarm device disable state).

When the set circuit 123 does not receive a set signal input from a set signal generator 124, it outputs the residual quantity detection signal; otherwise, it sets its output signal at "H" level irrespective of the residual quantity detection signal (alarm device enable state). The reset circuit 121 and the set circuit 123 perform set and reset processing using RS flip-flops.

The reset signal generator 122 produces a reset signal and outputs the signal to the reset circuit 121 in accordance with a reset timing.

The reset signal generator 122 receives a trigger pulse drive signal of the pump 9 or the right carriage turn signal for instructing right carriage turn signal of the carriage 2, and produces a pulse signal having a predetermined pulse width using a monostable multivibrator. The generator 122 outputs the pulse signal as a reset signal in accordance with this pulse signal and an output signal (alarm signal) from the set circuit 123.

When the alarm signal is at "H" level, the alarm device 25 is operated, and when the alarm signal is at "L" level, the alarm device 25 is not operated. More specifically, the reset signal generator 122 receives the pump drive signal, and outputs the reset signal to the reset circuit only when the alarm signal is at "L" level. During the operation of the pump 9, since the residual quantity detection signal "H" indicating the "small" residual quantity of ink is erroneously output, the residual quantity detection signal (error signal) is reset by the reset circuit 121, and is output to the alarm device 25 as a correct alarm signal.

When the carriage 2 performs a left carriage turn, the detecting device 60 erroneously outputs a residual quantity detection signal "L" (error signal) when the residual quantity of ink is "small" and the alarm signal is at "H" level. Therefore, the set signal generator 124 pulse-shapes the left carriage turn signal only when the alarm signal is at "H" level, and outputs a set signal to the set circuit 123. Therefore, the residual quantity detection signal (error signal) which is output from the detecting means 60 and passes through the reset circuit is set by the set circuit 123, and is output to the alarm device 25 as a correct alarm signal.

The operation of the 11th embodiment of the present invention will be described with reference to FIG. 24.

Figure 24:
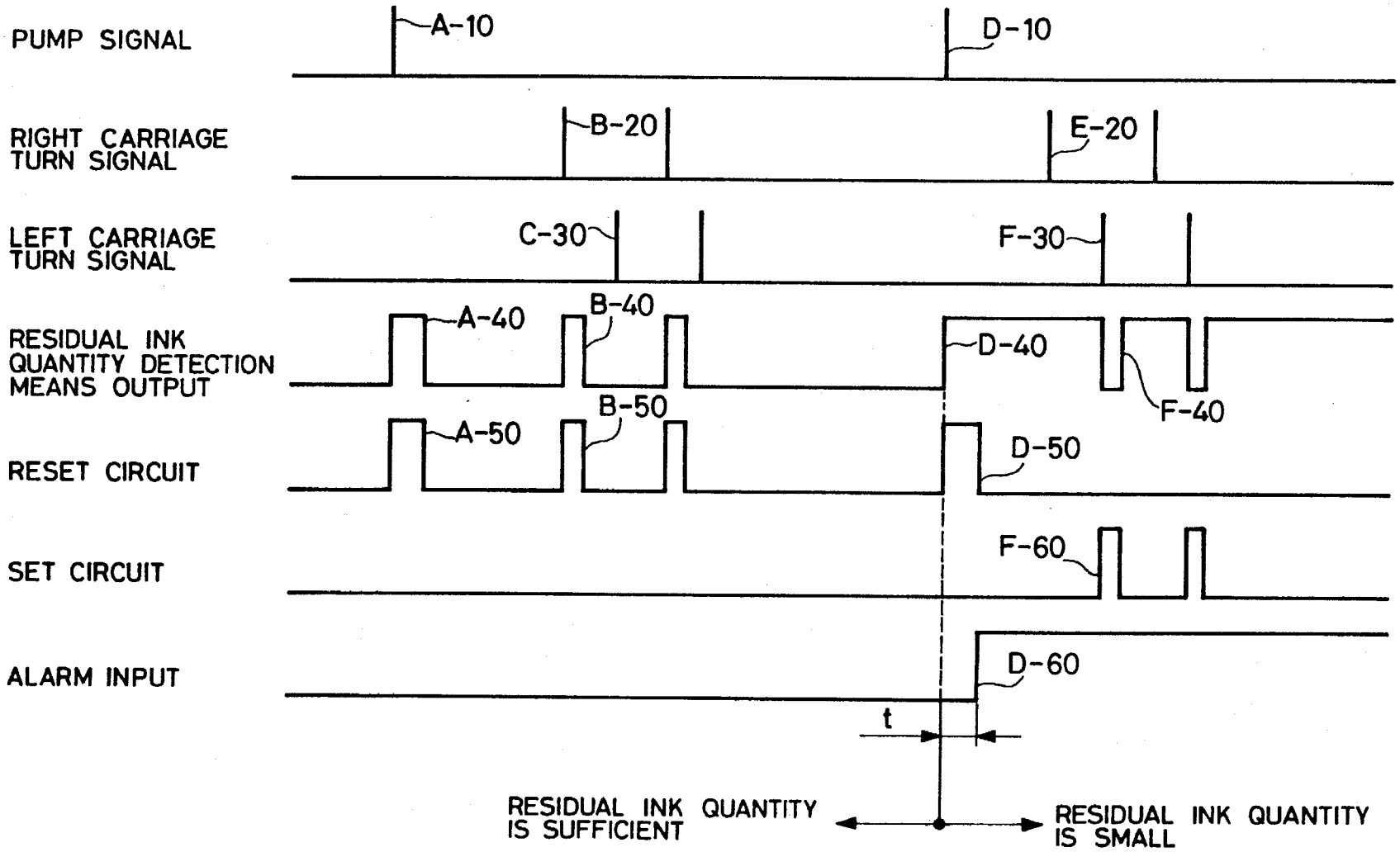
FIG. 24 is a timing chart showing input/output signals in respective devices in the 11th embodiment of the present invention.

FIG. 24 shows timings of input/output signals in the 11th embodiment of the present invention.

In FIG. 24, when the residual quantity of ink is "sufficient", the output from the residual quantity detecting means 60 represents an inoperative state "L". However, the terminals 60-8 and 60-9 of the detecting means 60 are disconnected by a negative pressure due to the pump 9 or the right carriage turn at a timing indicated by a waveform A-40, and a residual quantity detection signal "H" (erroneous operation output) is output. In this case, since the alarm device input is at "L" level, a reset signal A-50 formed by a pump signal A-10 or a right carriage turn signal C-30 (a reset signal B-50 in the case of the right carriage turn signal) is output. Therefore, when the detecting means 60 is erroneously Operated in the case of the "sufficient" residual quantity of ink, the reset circuit 121 receives the reset signal and outputs the alarm signal "L" to the alarm device 25. Thus, the alarm device 25 does not produce an alarm. When a left carriage turn is performed, since the set signal generator 124 produces no set signal, the residual quantity detection signal "L" from the detecting means 60 is output to the alarm device 25 as the alarm signal.

When the residual quantity of ink is small, the detecting means 60 normally outputs a residual quantity detection signal "H". However, the detecting means 60 outputs a residual quantity detection signal "L" (erroneous operation output) as indicated by a waveform F-40 due to the pressure caused by the left carriage turn. In this case, since the alarm device 25 receives the "H" input, the set signal generator 124 outputs the set signal produced by the left carriage turn signal to the set circuit 123, thereby setting the residual quantity detection signal by the set circuit 123. Then, the alarm signal "H" is output to the alarm device 25. For this reason, when the detecting means 60 is erroneously operated in the case of the "small" residual quantity of ink, the set signal is input, and the input signal to the alarm device 25 can be kept in an operative state "H".

When the residual quantity of ink is changed from "sufficient" to "small" while the residual quantity detecting means 60 is normally operated, ink will be consumed. Therefore, a change in residual quantity can be detected during the printing operation wherein the pump is driven and the carriage turn signal is produced. In this case, the input to the alarm device 25 is delayed by time t with respect to the operation timing of the residual quantity detecting means. However, the time t is at most several seconds, and will not pose any serious problem during the use of the ink-jet printer.

Figure 25:
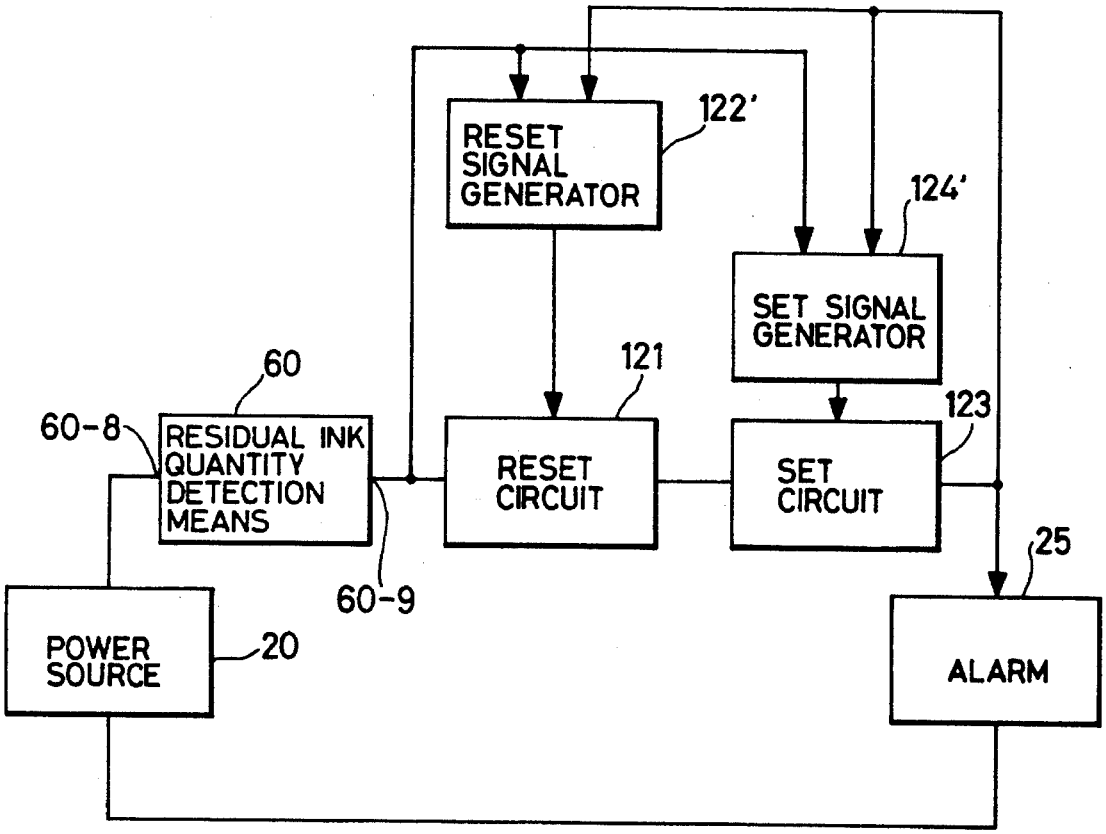
FIG. 25 is a block diagram showing a circuit arrangement in a 12th embodiment of the present invention.

FIG. 25 shows a circuit arrangement according to a 12th embodiment of the present invention.

The same reference numerals in FIG. 25 denote the same parts as in FIG. 23.

A reset signal generator 122' outputs a reset signal to the reset circuit 121 when it is detected that the detection signal from the residual quantity detecting means 60 goes from "L" level to "H" level, i.e., when the detecting means 60 is erroneously operated due to the operation of the pump 9 and a right carriage turn and when it is detected the residual quantity of ink is changed from "sufficient" to "small". A purse width t is set to be a time larger than the pump erroneous operation time t1 and a carriage turn time t2. Therefore, if the pump 9 is driven or the carriage turn is performed when the quantity of ink is "sufficient", the residual quantity detection signal "H" output from the detecting means 60 is set using the reset signal output from the reset signal generator 122' in the reset circuit 121, and a correct alarm signal "L" is output from the reset circuit 121 to the alarm device 25. When the residual quantity of ink is changed from "sufficient" to "small" the reset signal is output from the reset signal generator 122' to the reset circuit 121. However, after the reset signal is output, the reset signal generator 122' receives the signal "H" from the detecting means 60 and will not output the reset signal. Therefore, the residual quantity detection signal "H" from the detecting means 60 is output to the alarm device 25 as the alarm signal. The residual quantity detection is delayed by the reset time t as indicated by a waveform D-60 in FIG. 24. However, this time is several seconds and poses no problem in an actual use of the ink-jet printer.

A set signal generator 124' detects the trailing edge of the erroneous operation signal "L" from the detecting means 60 caused by a left carriage turn when the input alarm signal to the alarm device 25 is at "H" level, and produces a set signal to the set circuit 123. When the set signal is output to the set circuit 123, the signal "L" output from the detecting means 60 is set by the set circuit 123, and is output to the alarm device 25 as the alarm signal "H". Therefore, the error signal from the detecting means 60 will not be transferred to the alarm device 25.

In this embodiment, the reset circuit 121 and the set circuit 123 comprise RS flip-flops. However, they can be circuits, constituted by AND gates or OR gates, which can produce a signal for compensating for an error signal from the residual quantity detecting means 60.

According to the 11th and 12th embodiments of the present invention as described above, the erroneous operation of the residual quantity detecting means is detected, and the erroneous operation signal can be compensated and output to the alarm device. Therefore, the residual quantity of ink can be reliably detected.

What we claim is:

1. A recording apparatus comprising:

a recording head for recording by discharging ink onto a recording medium;

scan means for reciprocally scanning said recording head along a main scan direction;

a supply system provided at a position not scanned by said scan means in said recording apparatus and containing an amount of the ink therein, said supply system being operable in connection with the supply of ink to said recording head;

control means for controlling an operation including a switch of said scan means in the scan direction thereof;

residual ink quantity detecting means for detecting a residual ink quantity in said supply system, said detecting means including a deviation member connected to an ink supply path of said ink supply system to form a part thereof, said deviation member being deviated upon a change in pressure in the ink supply path, thereby detecting a residual ink quantity by detecting a deviation of the deviation member;

output means for outputting a signal relating the operation control of the scan direction switch of said scan means by said control means with a predetermined time delay; and residual ink quantity detection control means for causing said residual ink quantity detecting means to perform a residual ink quantity detection based on the signal outputted from said output means.

2. A recording apparatus according to claim 1, wherein said residual ink quantity detecting means detects the residual ink quantity based on an electrical contracted state of a fixed first electrode and a second electrode provided on said deviation means.

3. A recording apparatus according to claim 2, wherein the recording head is of a type discharging an ink by applying thermal energy to the ink.

4. A recording apparatus according to claim 1, further comprising alarm means for generating an alarm based on the detected result by said residual ink quantity detecting means.

5. A recording apparatus according to claim 4, wherein the recording head is of a type discharging an ink by applying thermal energy to the ink.

6. A recording apparatus according to claim 1, wherein the recording head is of a type discharging an ink by applying thermal energy to the ink.

7. A detecting apparatus usable with a recording apparatus having a recording head, scan means for reciprocally scanning the recording head along a main scan direction, and a supply system provided at a position not scanned by the scan means in the recording apparatus and containing an amount of the ink therein, said supply system being operable in connection with the supply of ink to the recording head for discharging the ink, the detecting apparatus comprising:

control means for controlling an operation including a switch of said scan means in the scan direction thereof;

residual ink quantity detecting means for detecting a residual ink quantity in said supply system, said detecting means including a deviation member connected to an ink supply path of said ink supply system to form a part thereof, said deviation member being deviated upon a change in pressure in the ink supply path, thereby detecting a residual ink quantity by detecting a deviation of the deviation member;

output means for outputting a signal relating the operation control of the scan direction switch of said scan means by said control means with a predetermined time delay; and residual ink quantity detection control means for causing said residual ink quantity detecting means to perform a residual ink quantity detection based on the signal outputted from said output means.

8. A detecting apparatus according to claim 7, wherein the recording head is of a type discharging an ink by applying thermal energy to the ink.

9. A method of detecting a residual quantity of an ink in a recording apparatus supply system for containing the ink, said supply system being operable in connection with the supply of ink to a recording head reciprocally scanned along a main scan direction by a scan means for recording by discharging the ink onto a recording medium, the residual ink ,quantity in the supply system being detected by residual ink quantity detection means including a deviation member connected to an ink supply path of the ink supply system to form a part thereof, the deviation member being deviated upon a change in pressure in the ink supply path, thereby detecting a residual ink quantity by detecting a deviation of the deviation member, the method comprising the steps of:

outputting a signal relating to an operation control of a scan direction switch of the recording head by the scan means with a predetermined time delay; and detecting the residual ink quantity by the residual ink quantity detection means corresponding to the signal outputted in said outputting step with the predetermined time delay.

10. A detecting method according to claim 9, wherein in said detecting step the residual ink quantity is detected based on an electrical contracted state of a fixed first electrode and a second electrode provided on the deviation means.

11. A detecting method according to claim 10, further comprising a step for generating an alarm based on the detected result by the residual ink quantity detecting means.

12. A recording apparatus comprising:

a recording head for discharging ink;

an ink supply system for containing an amount of ink to be supplied to said recording head;

a carriage for mounting said recording head;

scanning means for scanning said recording head along a recording medium;

residual ink quantity detecting means for detecting a residual ink quantity in said supply system, said detecting means including a deviation member connected to an ink supply path of said ink supply system to form a part thereof, said deviation member being deviated upon a change in pressure in the ink supply path, thereby detecting a residual ink quantity by detecting a deviation of the deviation member; and control means for controlling said detecting means to detect the amount of ink in said ink supply system after a lapse of a predetermined delay from a time when a direction of movement of said carriage by said scanning means is changed.

13. A recording apparatus according to claim 12, wherein the predetermined delay is a time interval that permits the detection by said detecting means substantially without influence thereof by the change in direction of said carriage.

14. A recording apparatus according to claim 13, wherein the recording head is of a type discharging an ink by applying thermal energy to the ink.

15. A recording apparatus according to claim 12, wherein said residual ink quantity detecting means detects the residual ink quantity based on an electrical contracted state of a fixed first electrode and a second electrode provided or said deviation.

16. A recording apparatus according to claim 15, wherein the recording head is of a type discharging an ink by applying thermal energy to the ink.

17. A recording apparatus according to claim 12, further compromising alarm means for generating an alarm based on the detected result by said residual ink quantity detecting means.

18. A recording apparatus according to claim 17, wherein the recording head is of a type discharging an ink by applying thermal energy to the ink.

19. A recording apparatus according to claim 12, wherein the recording head is of a type discharging an ink by applying thermal energy to the ink.

20. A recording apparatus comprising:

a recording head for discharging an ink therefrom;

an ink supply system for containing an ink to be supplied to said recording head;

pump means provided at a midway of an ink path extending from said ink supply system to said recording head for applying a force to supply the ink from said ink supply system;

recovery means for performing a recovery operation to recover a discharge condition of said recording head;

residual ink quantity detecting means for detecting a residual ink quantity in said supply system, said detecting means including a deviation member connected to an ink supply path of said ink supply system to form a part thereof, said deviation member being deviated upon a change in pressure in the ink supply path, thereby detecting a residual ink quantity by detecting a deviation of the deviation member; and control means for controlling said residual ink quantity detecting means to detect the residual ink quantity in said ink supply system with a predetermined delay after a time when said pump means applies the force to the ink.

21. A recording apparatus according to claim 20, wherein the predetermined delay is a time interval that permits the detection by said detecting means substantially without influence thereof by the operation of said pump means.

22. A recording apparatus according to claim 21, wherein the recording head is of a type discharging an ink by applying thermal energy to the ink.

23. A recording apparatus according to claim 20, wherein said recovery means performs the operation of said pump means by absorbing ink from said recording head and discharging the absorbed ink.

24. A recording apparatus according to claim 23, wherein the recording head is of a type discharging an ink by applying thermal energy to the ink.

25. A recording apparatus according to claim 20, wherein said residual ink quantity detecting means detects the residual ink quantity based on an electrical contacted state of a fixed first electrode and a second electrode provided or said deviation means.

26. A recording apparatus according to claim 25, wherein the recording head is of a type discharging an ink by applying thermal energy to the ink.

27. A recording apparatus according to claim 20, further comprising alarm means for generating an alarm based on the detected result by said residual ink quantity detecting means.

28. A recording apparatus according to claim 27, wherein the recording head is of a type discharging an ink by applying thermal energy to the ink.

29. A recording apparatus according to claim 20, wherein the recording head is of a type discharging an ink by applying thermal energy to the ink.

* * * * *

UNITED STATES PATENT AND TRADEMARK OFFICE

CERTIFICATE OF CORRECTION

PATENT NO. : 5,623,290

DATED : April 22, 1997

INVENTOR(S) : HIROSHI IIDA ET AL.

It is certified that error appears in the above-identified patent and that said Letters Patent is hereby corrected as shown below:

Item

AT [63] RELATED U.S. APPLICATION DATA

"Continuation of Ser. No. 622,187," should read --division of Ser. No. 622,187,--.

COLUMN 1

Line 7, "continuation" should read --division--.
Line 58, "In the" should read --The--.
Line 59, "ratus, it" should read --ratus--.

COLUMN 2

Line 3, "has" should read --may present--.
Line 4, "problem in its reliability." should read --reliability problem.--.
Line 37, "arranged." should read --provided.--.
Line 63, "a" should be deleted.

COLUMN 5

Line 8, "illustrate" should read --illustrates--.
Line 35, "second" should read --seventh--.

COLUMN 6

Line 13, "capping 10" should read --capping device 10--.
Line 48, "66" should read --65--.
Line 50, "66" should read --65--.

UNITED STATES PATENT AND TRADEMARK OFFICE

CERTIFICATE OF CORRECTION

PATENT NO. : 5,623,290

DATED : April 22, 1997

INVENTOR(S) : HIROSHI IIDA ET AL.

It is certified that error appears in the above-identified patent and that said Letters Patent is hereby corrected as shown below:

COLUMN 9

Line 15, "which seals" should read --which is sealed--.
Line 52, "capping 10" should read --caping device 10--.
Line 66, "capping 10" should read --caping device 10--.

COLUMN 10

Line 19, "capping 10" should read --caping device 10--.
Line 30, "recover" should read --recovery--.
Line 55, "and" should read --and which--.
Line 56, "recovery" should read --recover-- and "refilled" should read --refilled,--.

COLUMN 11

Line 67, "capping 9" should read --capping device 10--.

COLUMN 12

Line 23, "him to" should be deleted.
Line 24, "exchange" should read --exchange of--.
Line 32, "capping 9," should read --capping device 10,--.
Line 53, "capping 9," should read --capping device 10,--.
Line 54, "capping 9" should read --capping device 10--.

COLUMN 16

Line 37, "with" should read --width--.
Line 56, "signal H4." should read --signal H-4.--.

UNITED STATES PATENT AND TRADEMARK OFFICE

CERTIFICATE OF CORRECTION

PATENT NO. : 5,623,290

DATED : April 22, 1997

INVENTOR(S) : HIROSHI IIDA ET AL.

It is certified that error appears in the above-identified patent and that said Letters Patent is hereby corrected as shown below:

COLUMN 17

Line 22, "terminal 608" should read --terminal 60-8--.

COLUMN 18

Line 27, "Operated" should read --operated--.

COLUMN 19

Line 14, "small" should read --"small",--.

COLUMN 20

Line 11, "contracted" should read --contacted--.
Line 63, ", quantity" should read --quantity--.

COLUMN 21

Line 12, "contracted" should read --contacted--.
Line 14, "claim 10" should read --claim 9--.
Line 47, "contracted" should read --contacted--.
Line 48, "or" should read --on--.
Line 49, "deviation" should read --deviation means--.

UNITED STATES PATENT AND TRADEMARK OFFICE

CERTIFICATE OF CORRECTION

PATENT NO. : 5,623,290

DATED : April 22, 1997

INVENTOR(S) : HIROSHI IIDA ET AL.

It is certified that error appears in the above-identified patent and that said Letters Patent is hereby corrected as shown below:

COLUMN 22

Line 43, "or" should read --on--.

Signed and Sealed this

Twenty-fourth Day of February, 1998

Bruce Lehman

*Attest:*

BRUCE LEHMAN

*Attesting Officer*

*Commissioner of Patents and Trademarks*